US009521870B2

(12) United States Patent
Turner

(10) Patent No.: US 9,521,870 B2
(45) Date of Patent: Dec. 20, 2016

(54) ARTICLE OF APPAREL WITH DETACHABLY-SECURED ATTACHMENT COMPONENTS

(75) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1005 days.

(21) Appl. No.: 13/168,220

(22) Filed: Jun. 24, 2011

(65) Prior Publication Data

US 2011/0307998 A1 Dec. 22, 2011

Related U.S. Application Data

(63) Continuation-in-part of application No. 12/184,650, filed on Aug. 1, 2008, now abandoned.

(51) Int. Cl.

| | |
|---|---|
| ***A41D 13/00*** | (2006.01) |
| ***A41D 13/05*** | (2006.01) |
| *A41D 13/015* | (2006.01) |

(52) U.S. Cl.

CPC ..... *A41D 13/05* (2013.01); *A41D 13/0562* (2013.01); *A41D 13/0153* (2013.01)

(58) Field of Classification Search

CPC . A41D 13/05; A41D 13/0562; A41D 13/0153
USPC ..... 2/23, 244, 115, 80, 126, 69, 108, 105,2/106, 246, 49.1, 75, 79, 247, 22, 85, 93, 102,2/227, 250, 251, 252, 245; 40/586, 636, 329, 40/618
See application file for complete search history.

(56) References Cited

U.S. PATENT DOCUMENTS

| | | | |
|---|---|---|---|
| 3,119,904 | A | 1/1964 | Anson |
| 3,484,974 | A | 12/1969 | Culmone |
| 3,500,472 | A | 3/1970 | Castellani |
| 3,950,789 | A | 4/1976 | Konz |
| 4,249,268 | A | 2/1981 | Berler |
| 4,345,958 | A | 8/1982 | Kuroda |
| 4,384,369 | A | 5/1983 | Prince |
| 4,407,497 | A | 10/1983 | Gracie |

(Continued)

FOREIGN PATENT DOCUMENTS

| | | |
|---|---|---|
| DE | 102005060624 | 5/2007 |
| EP | 0962156 | 12/1999 |

(Continued)

OTHER PUBLICATIONS

International Search Report and Written Opinion in PCT Application No PCT/US2012/043170, mailed Oct. 18, 2012.

(Continued)

*Primary Examiner* — Khaled Annis
(74) *Attorney, Agent, or Firm* — Shook, Hardy & Bacon, LLP

(57) ABSTRACT

An article of apparel may include a base component and an attachment component. The base component may be formed from a plurality of joined material elements, with at least one of the material elements including a first part of a hook-and-loop fastening system. The attachment component may include (a) a cover layer, (b) a plurality of pad elements, and (c) a plurality of securing elements. Each of the pad elements are joined to the cover layer, and each of the securing elements are joined to at least one of the pad elements opposite the cover layer, with the securing elements including a second part of the hook-and-loop fastening system. Moreover, the first part of the hook-and-loop fastening system is joinable to the second part of the hook-and-loop fastening system to secure the attachment component to the base component.

14 Claims, 30 Drawing Sheets

(56) References Cited

U.S. PATENT DOCUMENTS

| | | | |
|---|---|---|---|
| 4,525,875 | A | 7/1985 | Tomczak |
| 4,688,269 | A | 8/1987 | Maeshima |
| 4,696,066 | A | 9/1987 | Ball |
| 4,815,149 | A | 3/1989 | Erhardt et al. |
| 4,982,447 | A | 1/1991 | Henson |
| 5,029,341 | A | 7/1991 | Wingo, Jr. |
| 5,048,123 | A | 9/1991 | Monson |
| 5,048,125 | A | 9/1991 | Libertini et al. |
| 5,054,127 | A | 10/1991 | Zevchak |
| 5,136,726 | A | 8/1992 | Kellin et al. |
| 5,334,082 | A | 8/1994 | Barker |
| 5,423,087 | A | 6/1995 | Krent et al. |
| 5,427,563 | A | 6/1995 | Manning |
| 5,454,743 | A | 10/1995 | Simonson |
| 5,484,448 | A | 1/1996 | Steele |
| 5,530,966 | A | 7/1996 | West |
| 5,536,246 | A | 7/1996 | Saunders |
| 5,539,934 | A | 7/1996 | Ponder |
| 5,621,914 | A | 4/1997 | Ramone et al. |
| 5,636,377 | A | 6/1997 | Wiener |
| 5,659,898 | A | 8/1997 | Bell, Jr. |
| 5,689,836 | A | 11/1997 | Fee et al. |
| 5,729,832 | A | 3/1998 | Grilliot et al. |
| 5,734,991 | A | 4/1998 | Schmid |
| 5,742,939 | A | 4/1998 | Williams |
| 5,826,273 | A | 10/1998 | Eckes |
| 5,860,163 | A | 1/1999 | Aldridge |
| 5,940,888 | A | 8/1999 | Sher |
| 5,953,747 | A | 9/1999 | Blanks |
| 5,957,692 | A | 9/1999 | McCracken et al. |
| 6,005,222 | A | 12/1999 | Hicks |
| 6,041,436 | A | 3/2000 | Keen |
| 6,098,198 | A | 8/2000 | Jacobs et al. |
| 6,105,162 | A | 8/2000 | Douglas et al. |
| 6,139,928 | A | 10/2000 | Sloot |
| 6,193,678 | B1 | 2/2001 | Brannon |
| 6,228,108 | B1 | 5/2001 | Lamb |
| 6,289,524 | B1 | 9/2001 | Wright et al. |
| 6,295,654 | B1 | 10/2001 | Farrell |
| 6,453,477 | B1 | 9/2002 | Bainbridge et al. |
| 6,484,325 | B1 | 11/2002 | Lazarus et al. |
| 6,519,781 | B1 | 2/2003 | Berns |
| 6,591,456 | B2 | 7/2003 | DeLuca et al. |
| 6,654,960 | B2 | 12/2003 | Cho |
| 6,666,836 | B1 | 12/2003 | Islava |
| 6,743,325 | B1 | 6/2004 | Taylor |
| 6,817,039 | B1 | 11/2004 | Grilliot et al. |
| 6,842,915 | B2 | 1/2005 | Turner et al. |
| 6,936,021 | B1 | 8/2005 | Smith |
| 6,982,115 | B2 | 1/2006 | Poulos et al. |
| 7,065,793 | B1 | 6/2006 | Wooten |
| 7,114,189 | B1 | 10/2006 | Kleinert |
| 7,276,076 | B2 | 10/2007 | Bieberich |
| 7,389,547 | B1 | 6/2008 | Wiens |
| 7,506,384 | B2 | 3/2009 | Ide et al. |
| 7,761,929 | B1 | 7/2010 | Mascia |
| 2002/0184925 | A1 | 12/2002 | McClellan et al. |
| 2003/0220048 | A1 | 11/2003 | Toro et al. |
| 2003/0236053 | A1 | 12/2003 | Martz |
| 2004/0019950 | A1 | 2/2004 | Rast |
| 2005/0009445 | A1 | 1/2005 | Bell et al. |
| 2005/0066407 | A1 | 3/2005 | Delaney |
| 2005/0081277 | A1* | 4/2005 | Matechen et al. ..... 2/102 |
| 2005/0085162 | A1 | 4/2005 | Ott |
| 2005/0278817 | A1 | 12/2005 | Doheny |
| 2006/0099884 | A1 | 5/2006 | Falla |
| 2006/0218692 | A1 | 10/2006 | Lamarque |
| 2006/0260026 | A1 | 11/2006 | Doria et al. |
| 2006/0277647 | A1 | 12/2006 | Dobkin |
| 2007/0000005 | A1 | 1/2007 | Wang |
| 2007/0094762 | A1 | 5/2007 | Carter et al. |
| 2007/0106352 | A1 | 5/2007 | Carstens |
| 2007/0185425 | A1 | 8/2007 | Einarsson et al. |
| 2007/0186327 | A1 | 8/2007 | Hall et al. |
| 2007/0186328 | A1 | 8/2007 | Bulian |
| 2007/0250976 | A1 | 11/2007 | Beliveau |
| 2008/0060113 | A1 | 3/2008 | Walsh |
| 2008/0264557 | A1 | 10/2008 | Kim |
| 2008/0290556 | A1 | 11/2008 | Kim |
| 2009/0070911 | A1 | 3/2009 | Chang |
| 2010/0024100 | A1 | 2/2010 | Sokolowski |
| 2010/0129573 | A1 | 5/2010 | Kim |
| 2010/0193117 | A1 | 8/2010 | Kim |
| 2010/0205716 | A1 | 8/2010 | Kim |
| 2010/0205722 | A1 | 8/2010 | Kim |
| 2010/0206472 | A1 | 8/2010 | Kim |

FOREIGN PATENT DOCUMENTS

| | | | |
|---|---|---|---|
| JP | S58161642 | A | 9/1983 |
| JP | H11279813 | A | 10/1999 |
| JP | 3067817 | U | 4/2000 |
| JP | 2001515548 | A | 9/2001 |
| JP | 2002348709 | | 4/2002 |
| WO | 9725953 | | 7/1997 |
| WO | 9811793 | A1 | 3/1998 |
| WO | 9841118 | A1 | 9/1998 |
| WO | 2004019713 | | 3/2004 |
| WO | 2006062810 | | 6/2006 |

OTHER PUBLICATIONS

Japanese Office Action dated Mar. 26, 2015 in Application No. 2013-211233, 6 pages.

Japanese Decision on Grant dated May 7, 2015 in Application No. 2011-521164, 2 pages.

Notification to Go Through Registration Formalities issued Feb. 19, 2014 in Chinese Patent Application No. 200980130062.1.

Chinese Office Action issued Feb. 24, 2014 in Chinese Patent Application No. 200980129947.X.

European Office Action issued Mar. 19, 2014 in European Patent Application No. 09790538.4.

Decision of Refusal issued Jan. 16, 2014 in Japanese Patent Application No. 2011-521164.

Non-Final Office Action dated Mar. 24, 2014 in U.S. Appl. No. 12/184,650.

International Preliminary Report on Patentability (including Written Opinion of the ISA) mailed Jan. 9, 2014 in International Application No. PCT/US2012/043170.

Final Office Action dated Jul. 8, 2014 in U.S. Appl. No. 12/184,650, 12 pages.

Japanese Office Action dated Aug. 10, 2016 in Japanese Patent Application No. 2015-147700, 4 pages.

* cited by examiner

ARTICLE OF APPAREL WITH DETACHABLY-SECURED ATTACHMENT COMPONENTS

CROSS-REFERENCE TO RELATED APPLICATION

This U.S. Patent Application is a continuation-in-part application and claims priority under 35 U.S.C. §120 to U.S. patent application Ser. No. 12/184,650, which was filed in the U.S. Patent and Trademark Office on 1 Aug. 2008 and entitled Apparel With Selectively Attachable And Detachable Elements, such prior U.S. Patent Application being entirely incorporated herein by reference.

BACKGROUND

Materials or elements that impart padding, cushioning, or otherwise attenuate impact forces are commonly incorporated into a variety of products. Athletic apparel, for example, often incorporates components that protect the wearer from contact with other athletes, equipment, or the ground. More specifically, pads used in American football and hockey incorporate components that provide impact protection to various parts of a wearer. Helmets utilized during American football, hockey, bicycling, skiing, snowboarding, and skateboarding incorporate components that provide head protection during falls or crashes. Similarly, gloves utilized in soccer (e.g., by goalies) and hockey incorporate components that provide protection to the hands of a wearer.

SUMMARY

An article of apparel is disclosed herein as including a base component and an attachment component. The base component may be formed from a plurality of joined material elements, with at least one of the material elements including a first part of a hook-and-loop fastening system. The attachment component may include (a) a cover layer, (b) a plurality of pad elements, and (c) a plurality of securing elements. Each of the pad elements are joined to the cover layer, and each of the securing elements are joined to at least one of the pad elements opposite the cover layer, with the securing elements including a second part of the hook-and-loop fastening system. Moreover, the first part of the hook-and-loop fastening system is joinable to the second part of the hook-and-loop fastening system to secure the attachment component to the base component.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose concepts associated with various articles of apparel that include attachment components detachably-secured with a hook-and-loop fastening system.

Apparel Configuration

Figure 1:
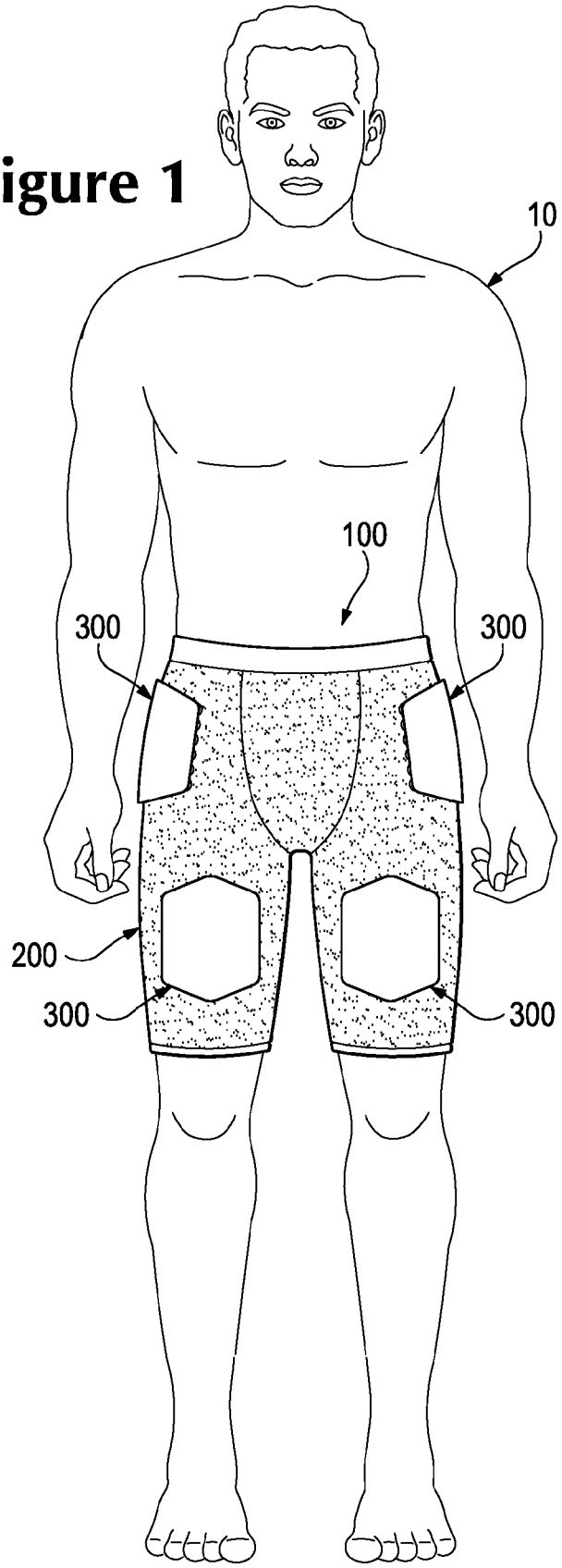
FIG. 1 is a front elevational view of an individual wearing an article of apparel.
Figure 2:
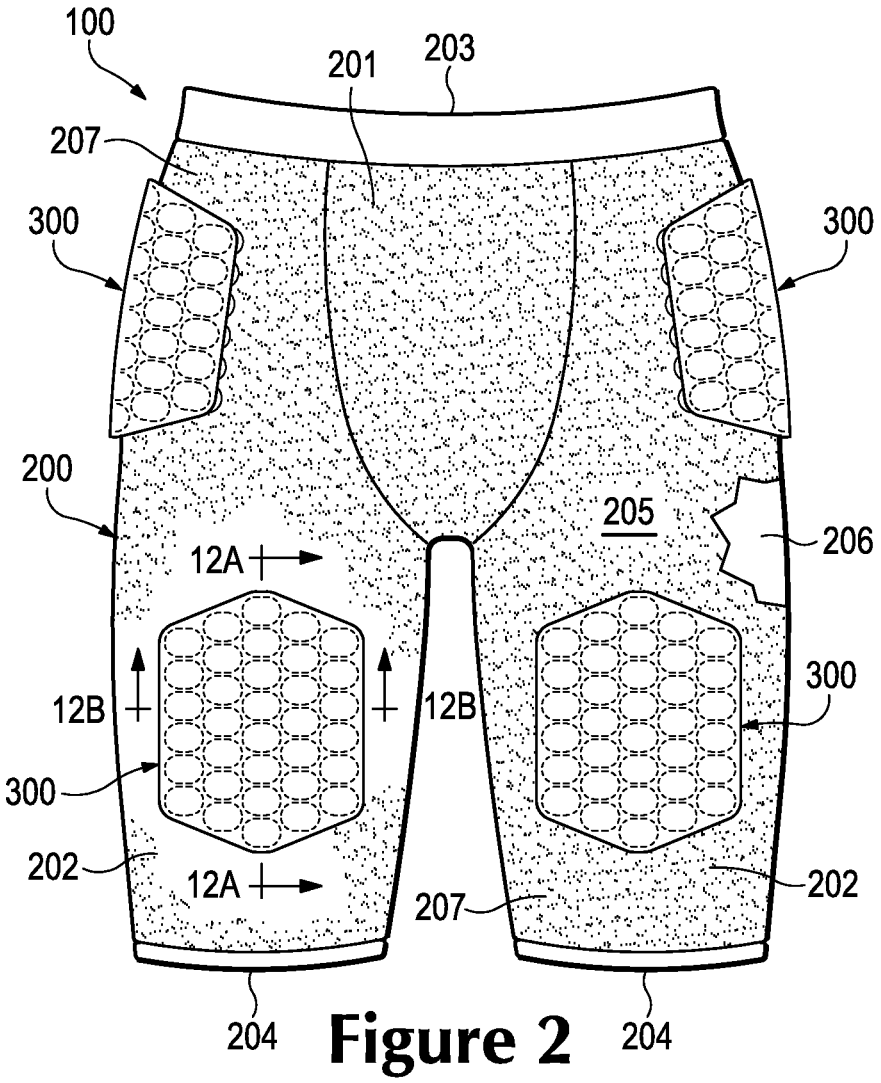
FIG. 2 is a front elevational view of the article of apparel.
Figure 3:
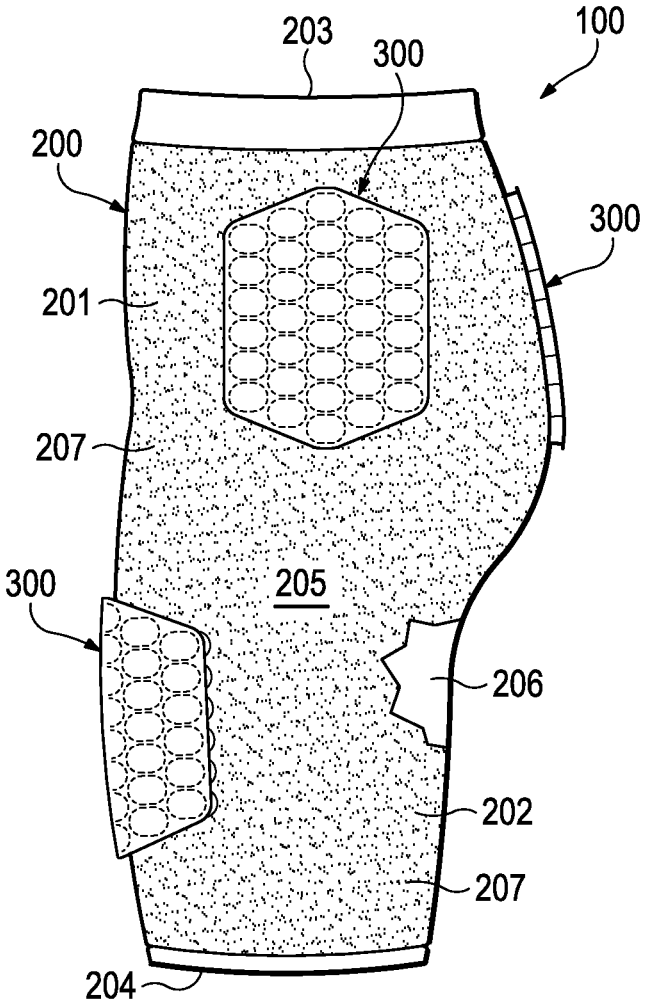
FIGS. 3 and 4 are side elevational views of the article of apparel.
Figure 4:
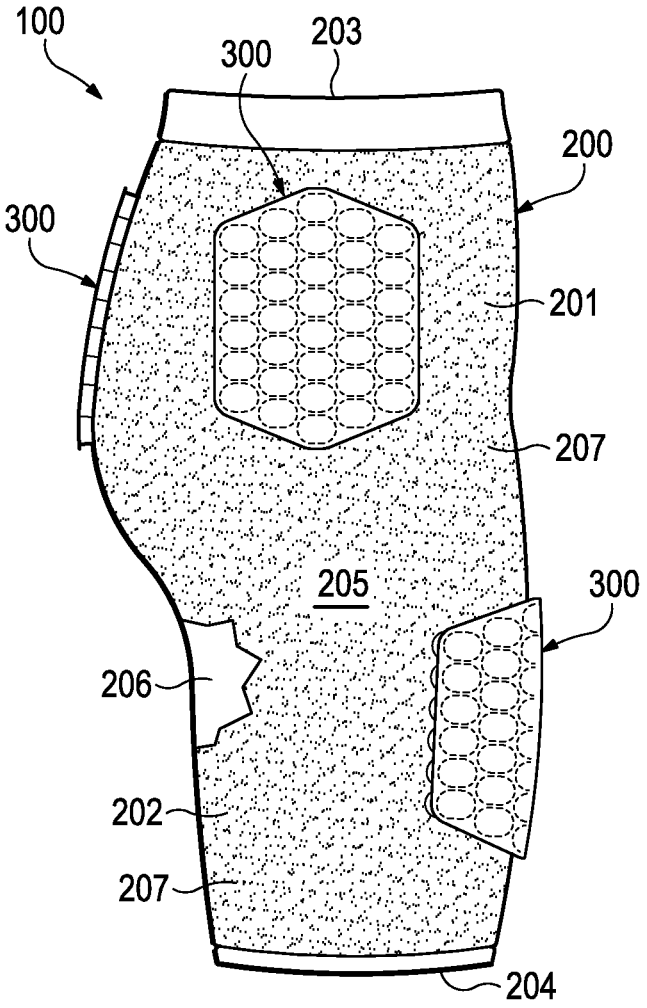
Figure 5:
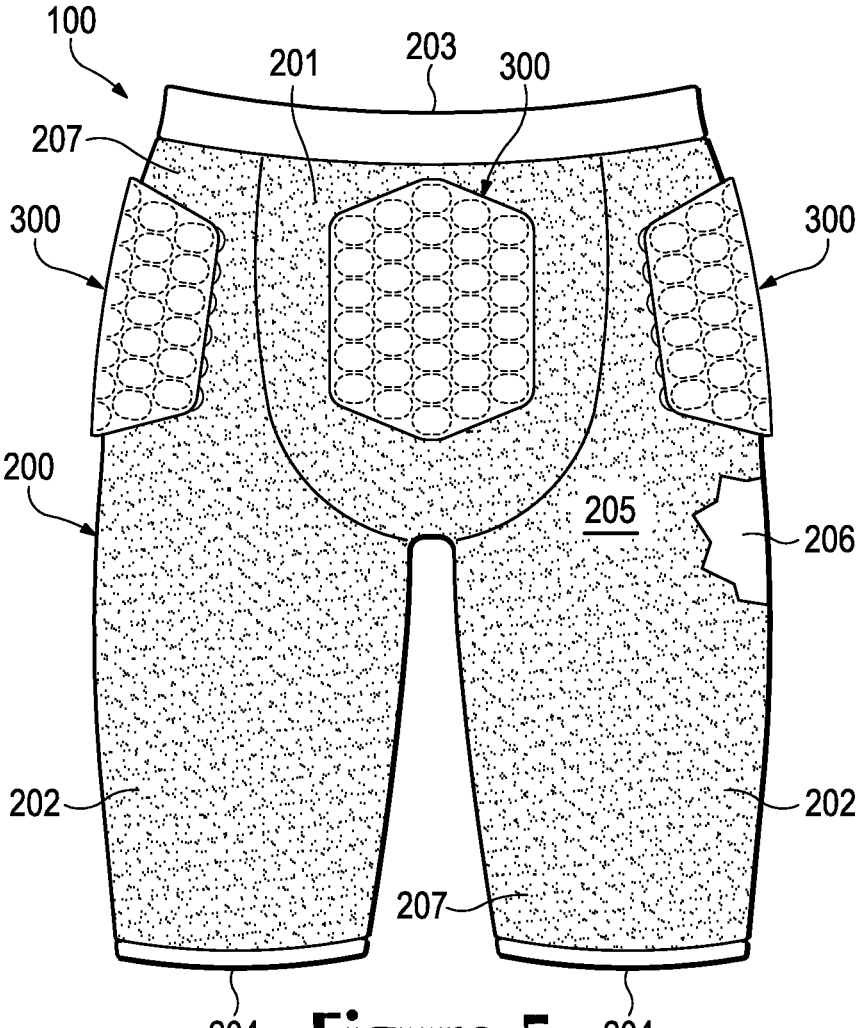
FIG. 5 is a rear elevational view of the article of apparel.

With reference to FIG. 1, an individual 10 is depicted as wearing an article of apparel 100 with the general configuration of a pair of shorts. Although apparel 100 may be worn under other articles of apparel, apparel 100 may be worn alone, may be exposed, or may be worn over other articles of apparel. Apparel 100 may also be worn in combination with other pieces of equipment (e.g., athletic or protective equipment). Accordingly, the configuration of apparel 100 and the manner in which apparel 100 is worn by individual 10 or another wearer may vary significantly.

Apparel 100 is depicted in FIGS. 2-5 as having a base component 200 and a plurality of attachment components 300. Base component 200 and attachment components 300 may be repeatedly secured together and detached from each other. That is, attachment components 300 may be secured to and detached from base component 200. As such, individual 10 may selectively (a) modify the positions and orientations of attachment components 300 on base component 200, (b) change the number of attachment components 300 secured to base component 200, and (c) exchange one type of attachment component 300 with another type of attachment component 300. Accordingly, the ability to repeatedly secure attachment components 300 to base component 200 and detach attachment components 300 from base component 200 provides individual 10 or another wearer with an ability to modify or otherwise customize aspects relating to apparel 100.

A hook-and-loop fastening system is utilized to secure base component 200 and attachment components 300 to each other. Moreover, the hook-and-loop fastening system permits base component 200 and attachment components 300 to be detached from each other. A hook-and-loop fastening system generally includes a hook part and a loop part. In general, the hook part includes a plurality of hooks that engage loops of the loop part. An examples of a hook-and-loop fastening system including both the hook part and the loop part is VELCRO, which is manufactured by VELCRO USA, Inc. of Manchester, N.H., United States of America. An example of a suitable textile that may form the loop part of the hook-and-loop fastening system is manufactured by RUEY TAY of Taipei, Taiwan, Republic of China, and is a warp knit mesh that includes both polyester and spandex (i.e., elastane). For purposes of reference, portions of apparel 100 incorporating the hook-and-loop fastening system or a part of the hook-and-loop fastening system are depicted as having a stippled or otherwise textured configuration in the figures.

Base component 200 is formed from various material elements (e.g., textiles, leather, synthetic leather, polymer sheets, elastic elements) that are stitched, bonded, or otherwise joined together to form a pelvic region 201 and a pair of leg regions 202. Pelvic region 201 corresponds with a pelvic area of the wearer (e.g., individual 10), thereby covering at least a portion of the pelvic area when worn. An upper portion of pelvic region 201 defines a waist opening 203 that extends around a waist of the wearer. Leg regions 202 extend outward from pelvic region 201 and correspond with a right leg and a left leg of the wearer, thereby covering at least a portion of the right leg and the left leg when worn. Lower areas of leg regions 202 each define a thigh opening 204 that extends around a thigh of the wearer. Additionally, base component 200 includes an exterior surface 205 that faces away from the wearer, and base component 200 includes an opposite interior surface 206 that faces toward the wearer and may contact the wearer when apparel 100 is worn.

Base component 200 includes a first part 207 of a hook-and-loop fastening system, which may be either the hook part or the loop part. Referring to FIGS. 2-5, a majority of exterior surface 205 includes first part 207. In some configurations of apparel 100, many of the various material elements forming base component 200 may be the textile forming the loop part, which is noted above. That is, first part 207 may be the loop part of the hook-and-loop fastening system, as well as a textile that forms portions of both pelvic region 201 and leg regions 202 in base component 200. In other configurations, first part 207 may be separate elements that are secured (e.g., stitched, adhered, thermal bonded) to the material elements forming base component 200. A majority of exterior surface 205 is depicted as including first part 207. In further configurations, at least twenty-five percent or at least fifty percent of exterior surface 205 may include first part 207. An advantage to having at least twenty-five percent or fifty percent include first part 207 is that attachment components 300 may be secured to various areas of base component 200, and sufficient area is present to modify the positions, orientations, number, and types of attachment components 300, as discussed below.

Figure 6:
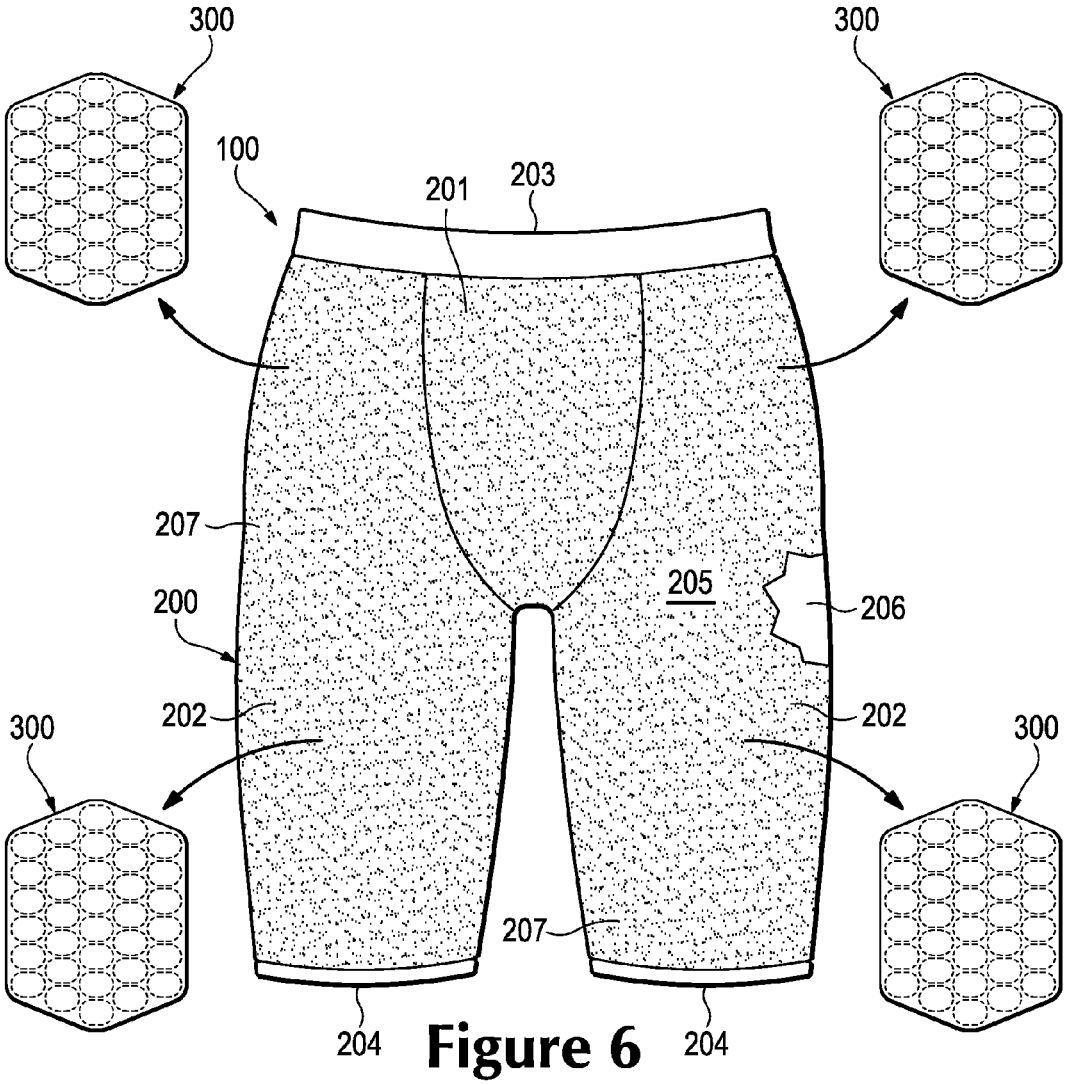
FIG. 6 is an exploded perspective view of the article of apparel.
Figure 7A:
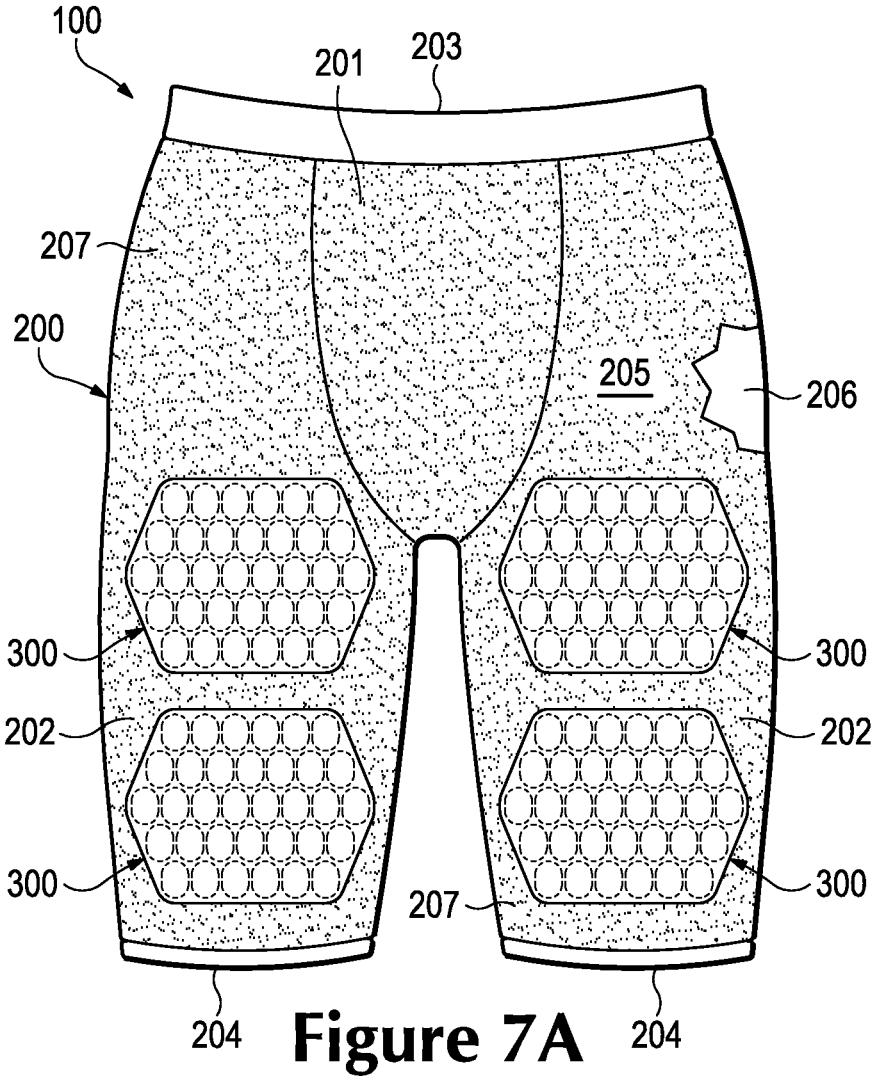
FIGS. 7A-7C are front elevational views depicting further configurations of the article of apparel.
Figure 7B:
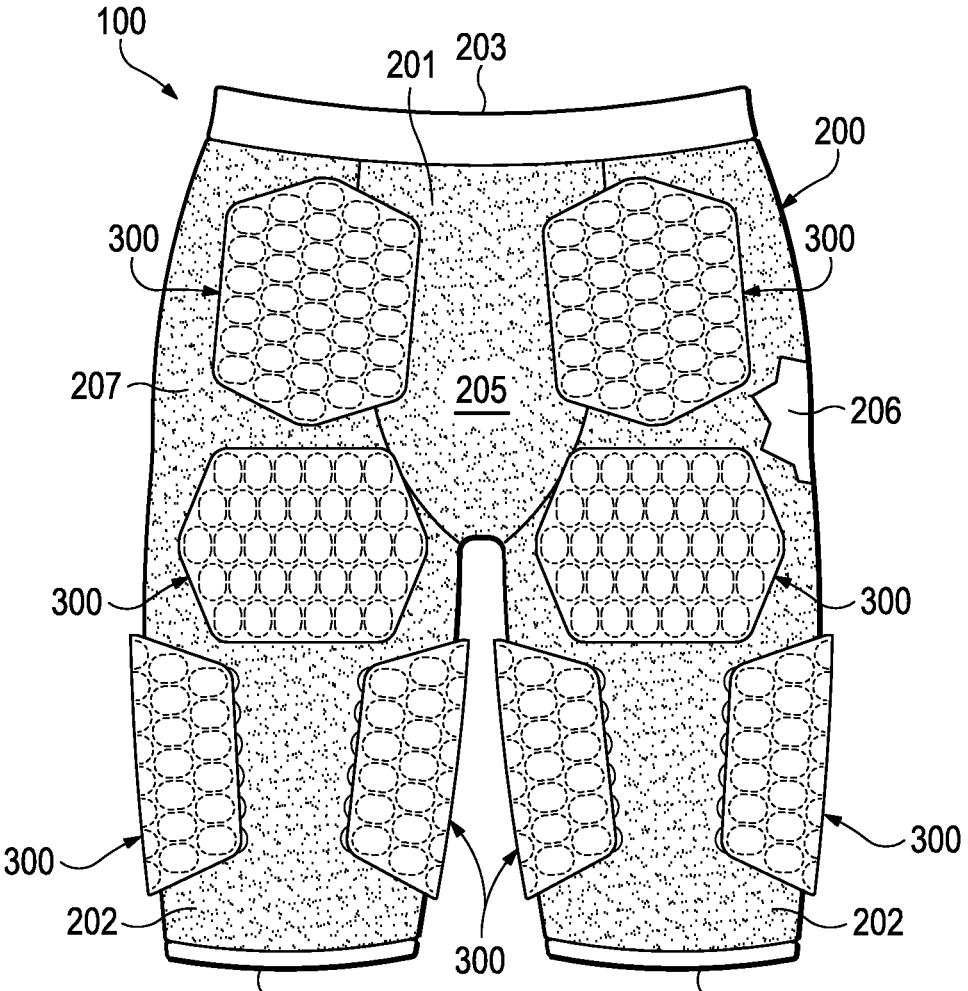
Figure 7C:
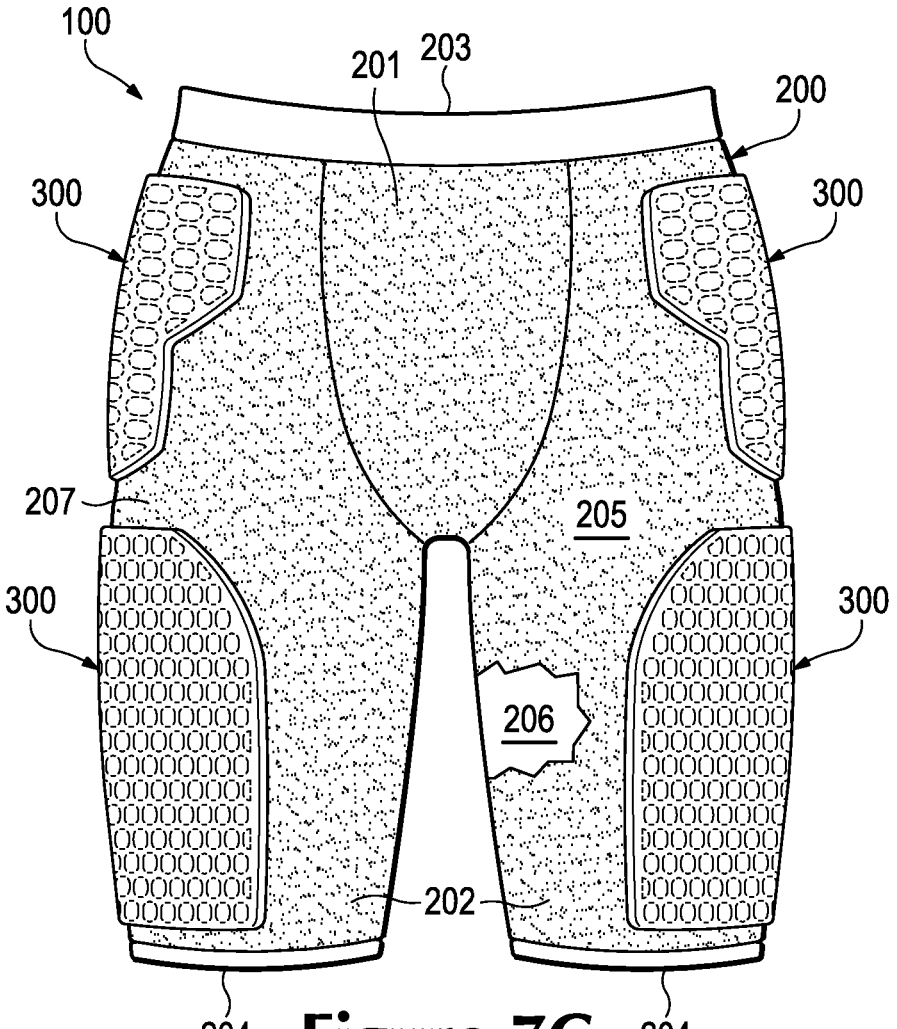
Figure 8:
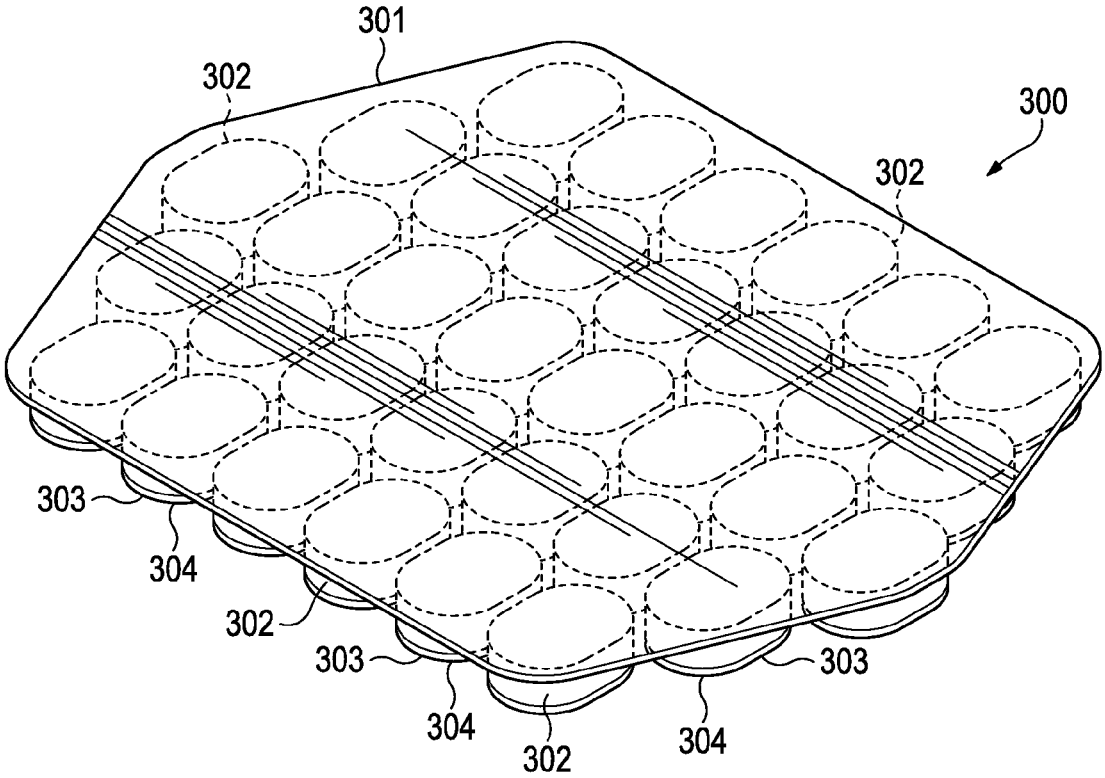
FIG. 8 is a perspective view of an attachment component from the article of apparel.
Figure 9:
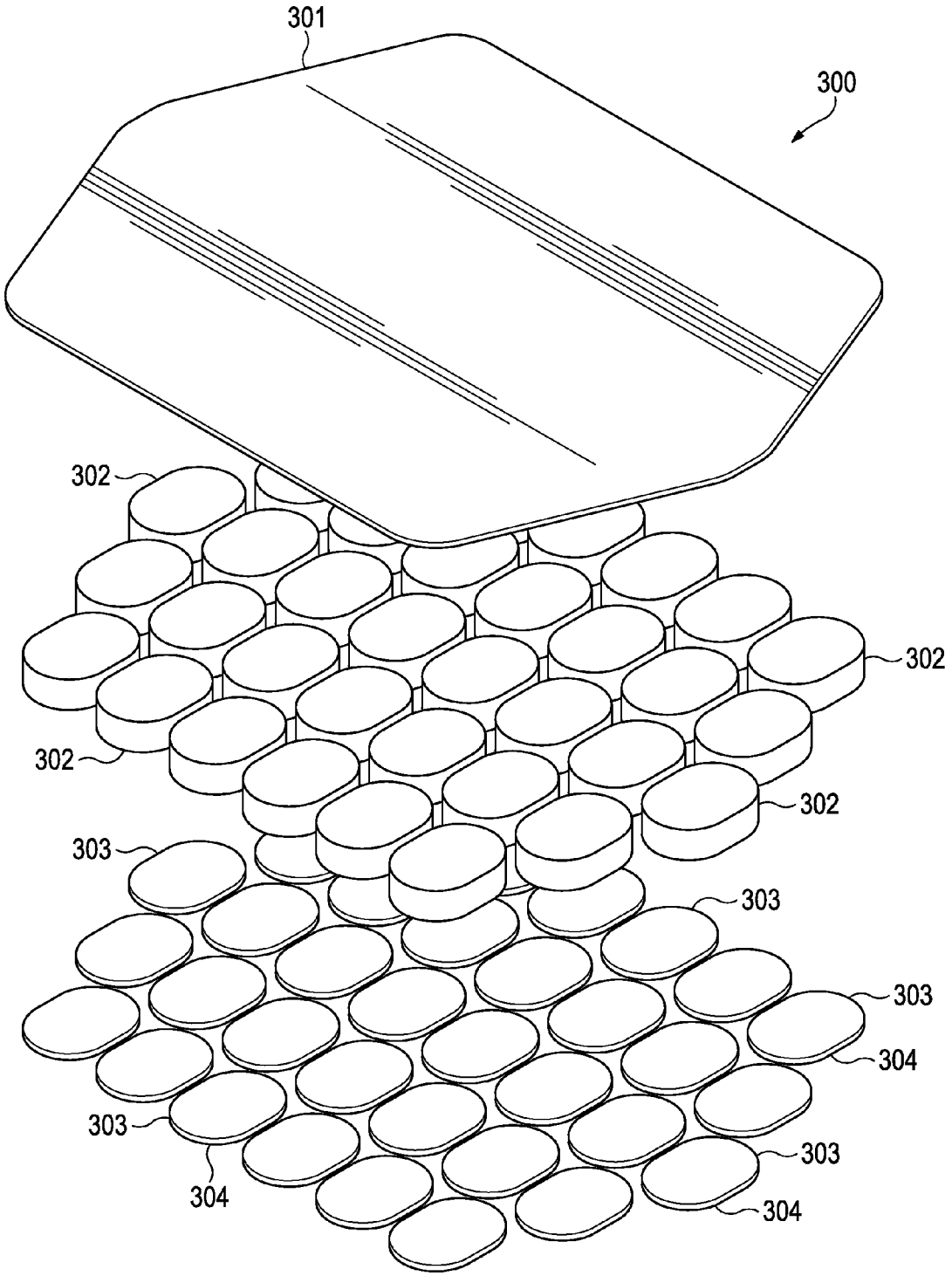
FIG. 9 is an exploded perspective view of the attachment component.
Figure 10:
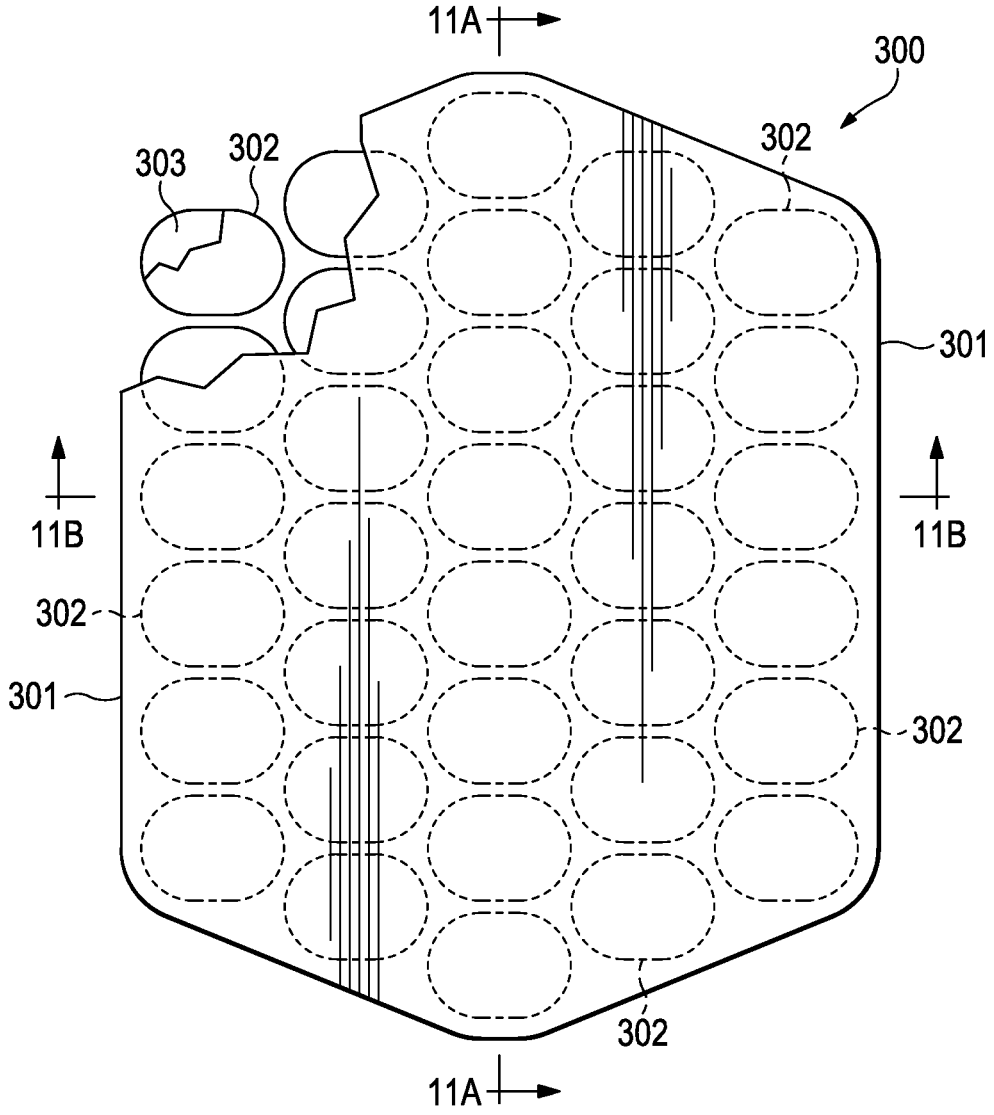
FIG. 10 is a top plan view of the attachment component.

Five of attachment components 300 are secured to exterior surface 205 of base component 200 in a variety of different locations. More particularly, two of attachment components 300 are secured to sides of pelvic region 201, two of attachment components 300 are secured to a front area of leg regions 202, and one of attachment components 300 is secured to a rear area of pelvic region 201. In addition to securing attachment components 300 to base component 200, the hook-and-loop fastening system permits attachment components 300 to be detached or otherwise separated from base component 200. Referring to FIG. 6, therefore, each of attachment components 300 are depicted as being separated from base component 200. As noted above, the wearer may modify the positions and orientations of attachment components 300 on base component 200. Referring to FIG. 7A, therefore, attachment components 300 are now secured to base component 200 in different positions and different orientations. Additionally, the wearer may change the number of attachment components 300 on base component 200. Referring to FIG. 7B, eight attachment components 300 are located on base component 200. Moreover, the wearer may exchange one type of attachment component 300 with another type of attachment component 300. Referring to FIG. 7C, the generally elongate attachment components 300 are replaced with larger and differently-shaped attachment components 300. Although not depicted, attachment components 300 may also be replaced or utilized in combination with other components, such as plates or electronic devices (e.g., mobile phones, portable music players, timing devices, heart-rate monitors, locator beacons, global positioning systems, or mobile computing devices). Accordingly, the hook-and-loop fastening system provides individual 10 or another wearer with an ability to modify or otherwise customize aspects relating to apparel 100.

One of attachment components 300 is depicted in FIGS. 8-11B as including a cover layer 301, a plurality of pad elements 302, and a plurality of securing elements 303. Cover layer 301 is secured to a surface of each pad element 302, and securing elements 303 are secured to an opposite surface of each pad element 302. In this configuration, pad elements 302 are located between and secured to each of cover layer 301 and securing elements 303. Whereas cover layer 301 is secured to all of pad elements 302, each securing element 303 is secured to one of pad elements 302.

A variety of materials may be utilized for cover layer 301, including various textiles, leather, synthetic leather, polymer sheets, and elastic elements, for example. Combinations of these materials (e.g., a polymer sheet bonded to a textile) may also be utilized for cover layer 301. With regard to textiles, cover layer 301 may be formed from knitted, woven, non-woven, spacer, or mesh textile components that include rayon, nylon, polyester, polyacrylic, elastane, cotton, wool, or silk, for example. Moreover, the textiles forming cover layer 301 may be non-stretch, may exhibit one-directional stretch, or may exhibit multi-directional stretch. In some configurations, cover layer 301 may be a rigid or semi-rigid plate. Accordingly, a variety of materials are suitable for cover layer 301.

Pad elements 302, as discussed above, are secured to both cover layer 301 and securing elements 303. As depicted, pad elements 302 are spaced from each other on cover layer 301. That is, one pad element 302 and another pad element 302 are joined to spaced areas of a surface of cover layer 302. The shapes of pad elements 302 may vary significantly. As depicted, however, the surfaces of pad elements 302 that are joined to cover layer 301 and securing elements 303 have an elliptical or generally elongate shape with rounded end areas. In other configurations, however, these surfaces may be round, square, rectangular, hexagonal, or irregular, for example. Pad elements 302 are also depicted as being spaced evenly from each other and arranged in rows, particularly offset rows, but may be spaced or located in a variety of arrangements. An advantage of arranging pad elements 302 in offset rows is that the area between pad elements 302 is effectively minimized, while retaining a regular spacing between adjacent pad elements 302.

A variety of materials may be utilized for pad elements 302, including various polymer foam materials that return to an original shape after being compressed.

Examples of suitable polymer foam materials for pad elements 302 include polyurethane, ethylvinylacetate, polyester, polypropylene, and polyethylene foams. Moreover, both thermoplastic and thermoset polymer foam materials may be utilized. In some configurations of attachment components 300, pad elements 302 may be formed from a polymer foam material with a varying density, or solid polymer or rubber materials may be utilized. Fluid-filled chambers (e.g., gas-filled or liquid-filled) may also be utilized as pad elements 302. Also, different pad elements 302 may be formed from different materials, or may be formed from similar materials with different densities. As discussed in greater detail below, the polymer foam materials or chambers forming pad elements 302 attenuate impact forces to provide cushioning or protection. By selecting thicknesses, materials, and densities for each of the various pad elements 302, the degree of impact force attenuation may be varied throughout attachment component 300 to impart a desired degree of cushioning or protection.

Figure 12A:
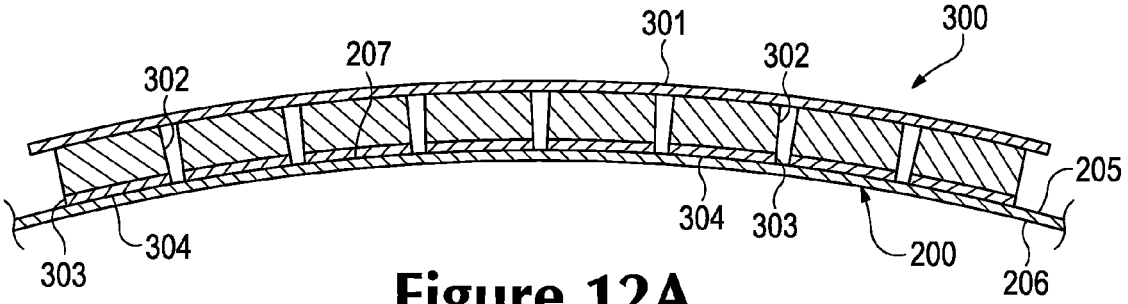
FIGS. 12A and 12B are cross-sectional views of the article of apparel, as defined by section lines 12A and 12B in FIG. 2.
Figure 12B:
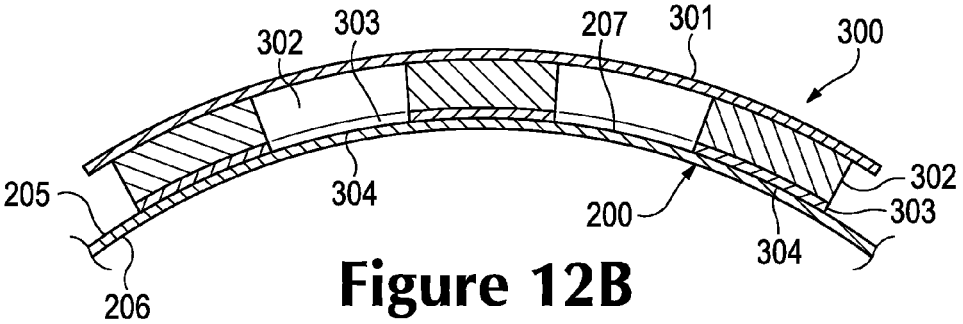

Securing elements 303 incorporate a second part 304 of the hook-and-loop fastening system. As discussed above, the hook-and-loop fastening system is utilized to secure base component 200 and attachment components 300 to each other. Moreover, the hook-and-loop fastening system permits base component 200 and attachment components 300 to be detached from each other. By making contact with first part 207 of the hook-and-loop fastening system, second part 304 will effectively secure base component 200 and attachment components 300 to each other, as depicted in FIGS. 12A and 12B. In configurations where first part 207 is the loop part of the hook-and-loop fastening system, second part 304 will be the hook part. In other configurations where first part 207 is the hook part of the hook-and-loop fastening system, second part 304 will be the loop part.

Attachment components 300 may be utilized in areas of apparel 100 where individual 10 or another wearer desire to have cushioning or protection. The compressible polymer foam materials or chambers forming pad elements 302 attenuate impact forces that compress or otherwise contact attachment component 300. When incorporated into attachment components 300, the polymer foam materials or chambers of pad elements 302 may compress to protect a wearer from contact with other athletes, equipment, or the ground. Accordingly, attachment components 300 may attenuate impact forces to provide cushioning or protection to the wearer.

In addition to attenuating impact forces, attachment components 300 have an advantage of simultaneously providing one or more of breathability, flexibility, a relatively low overall mass, and launderability. When wearing apparel 100, a wearer may perspire and generate excess heat. By utilizing a permeable textile for cover layer 301 and also forming gaps or spaces between adjacent pad elements 302, areas for air to enter apparel 100 and for moisture to exit apparel 100 are formed through attachment components 300. More particularly, air and moisture may pass through cover layer 301 and between pad elements 302 to impart breathability to areas of apparel 100 having attachment components 300. Moreover, the materials and structure discussed above for attachment components 300 impart flexibility (e.g., due to spaces between pad elements 302) and a low overall mass. Furthermore, the materials and structure discussed above permits attachment components 300 to be laundered without significant shrinkage or warping, even when temperatures associated with commercial laundering processes are utilized. Accordingly, attachment components 300 may simultaneously provide impact force attenuation, breathability, flexibility, a relatively low overall mass, and launderability to an article of apparel.

Apparel 100 may be manufactured through a variety of processes. In general, base component 200 may be formed by joining the various material elements with stitching, adhesive bonding, or thermal bonding, for example. Attachment components 300 may be generally formed by cutting or molding the various pad elements 302 and joining pad elements 302 to each of cover layer 301 and securing elements 303. Alternately, a manufacturing process may be used that is similar to a portion of a process disclosed in U.S. patent application Ser. No. 13/111,438, which was filed in the U.S. Patent and Trademark Office on May 19, 2011 and entitled Method Of Manufacturing Cushioning Elements For Apparel And Other Products, which is entirely incorporated herein by reference.

Further Apparel Configurations

Figure 13:
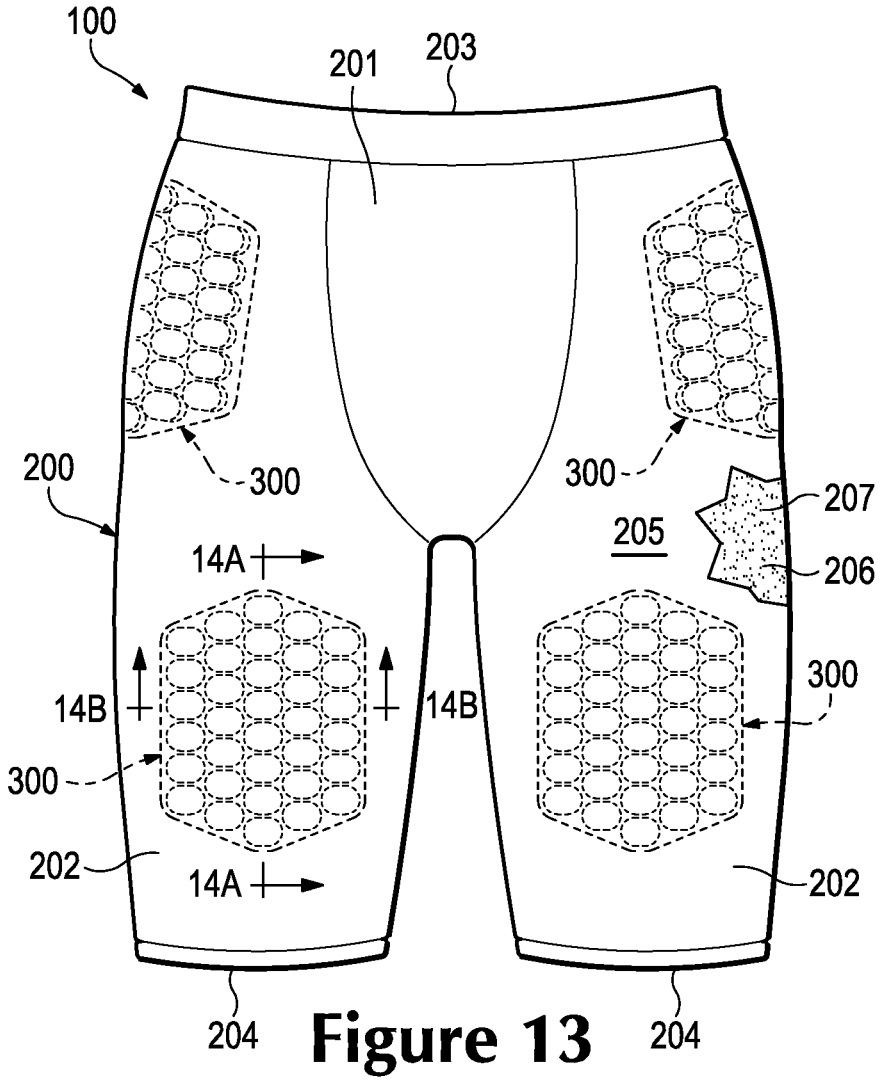
FIG. 13 is a front elevational view corresponding with FIG. 1 and depicting another configuration of the article of apparel.
Figure 14A:
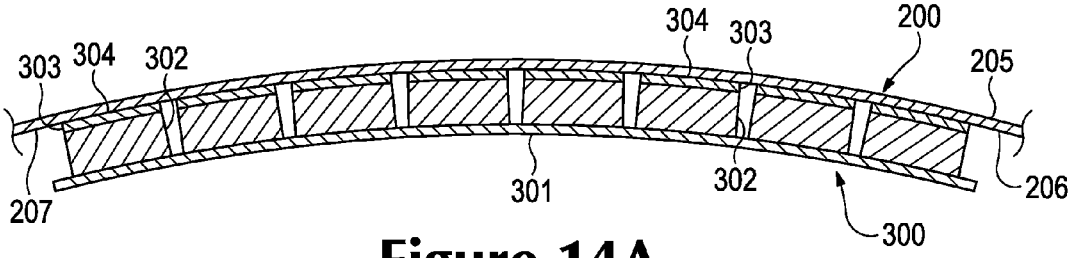
FIGS. 14A and 14B are cross-sectional views, as defined by section lines 14A and 14B in FIG. 13.
Figure 14B:
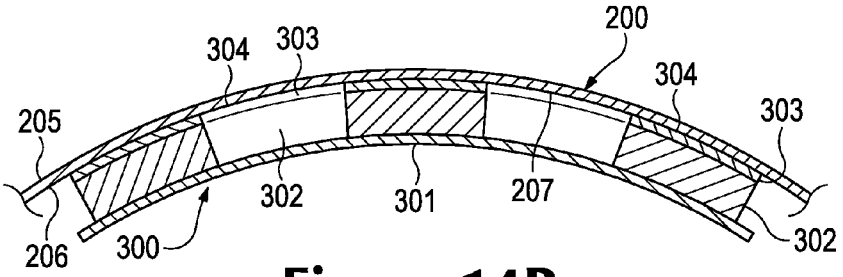

The configuration of apparel 100 discussed above provides one example of a suitable configuration for base component 200, attachment component 300, and the manner in which components 200 and 300 interface. A variety of other configurations may also be utilized. In the structure discussed above, attachment components 300 are secured to exterior surface 205 and are located exterior of base component 200. Referring to FIGS. 13, 14A, and 14B, attachment components 300 are secured to interior surface 206 and are located interior of base component 200. An advantage of this configuration is that attachment components 300 are compressed between the wearer and base component 200, which may significantly limit movement or the ability to detach of attachment components 300.

Figure 15A:
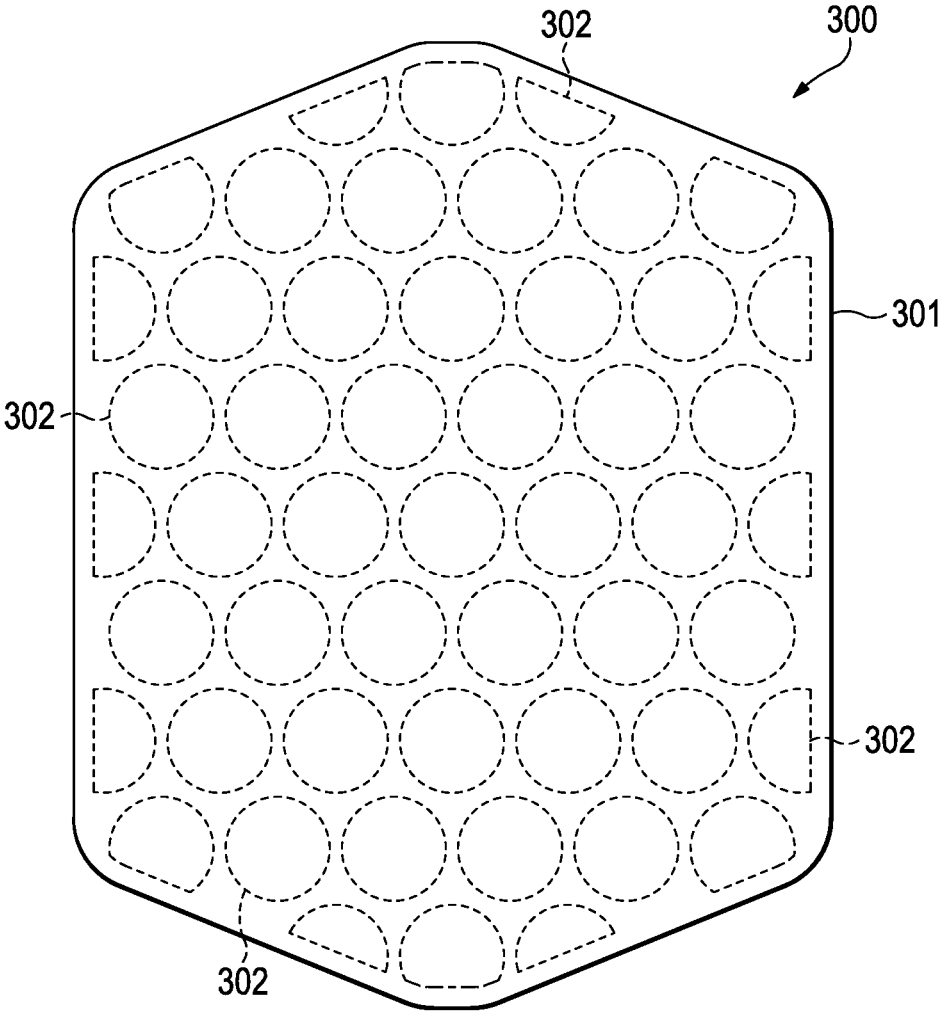
FIGS. 15A-15M are top plan views corresponding with FIG. 10 and depicting further configurations of the attachment component.
Figure 15B:
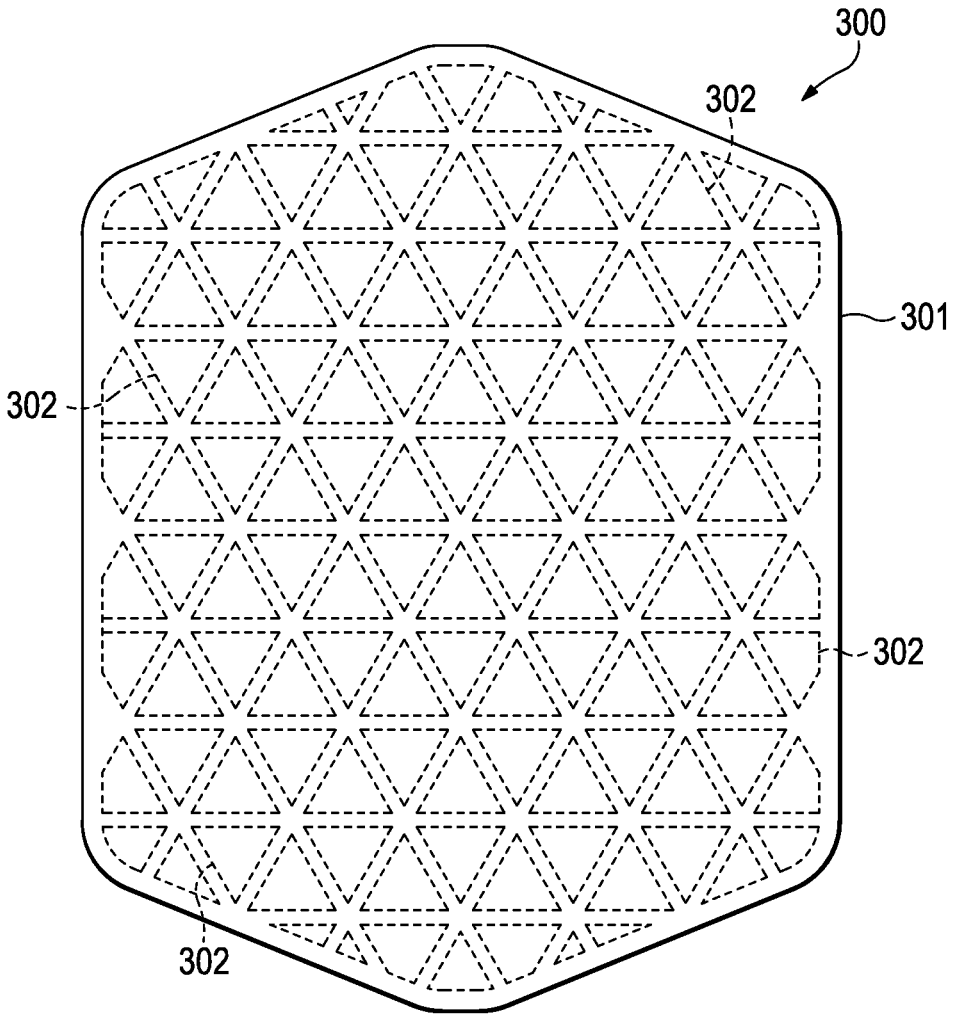
Figure 15C:
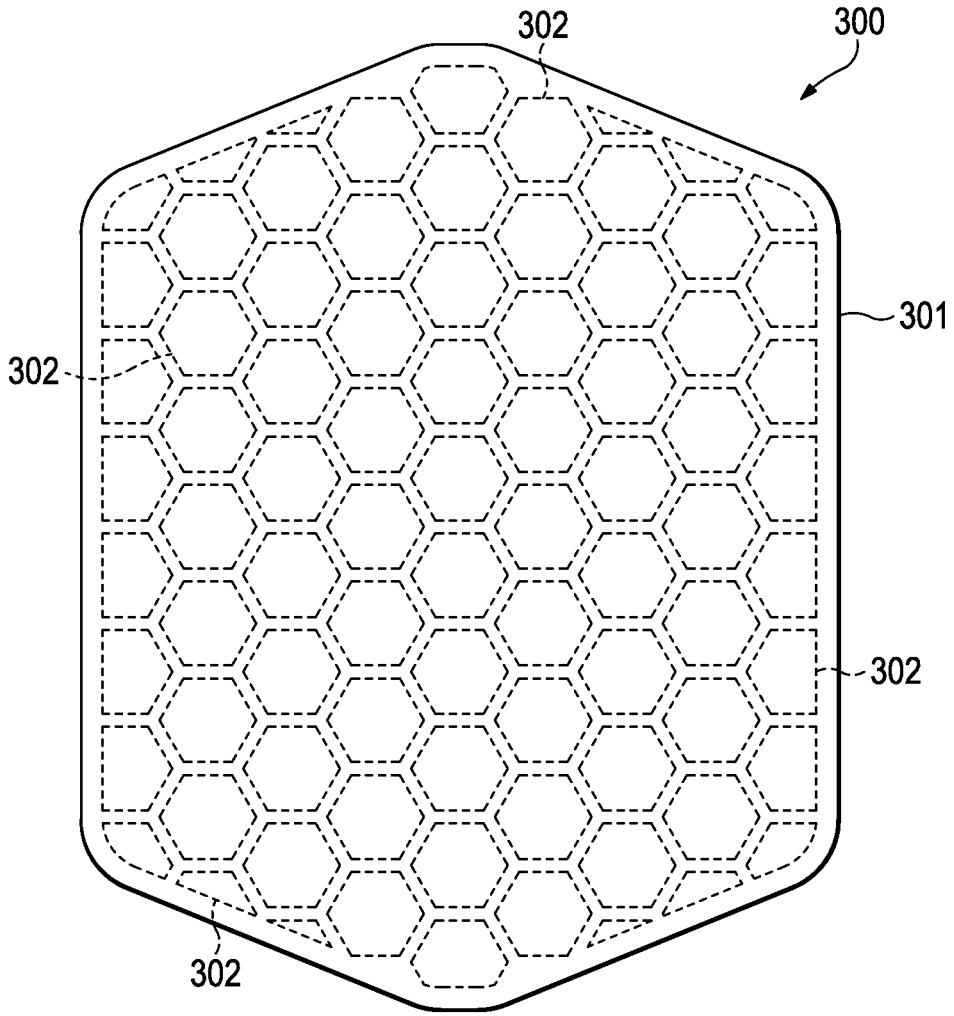
Figure 15D:
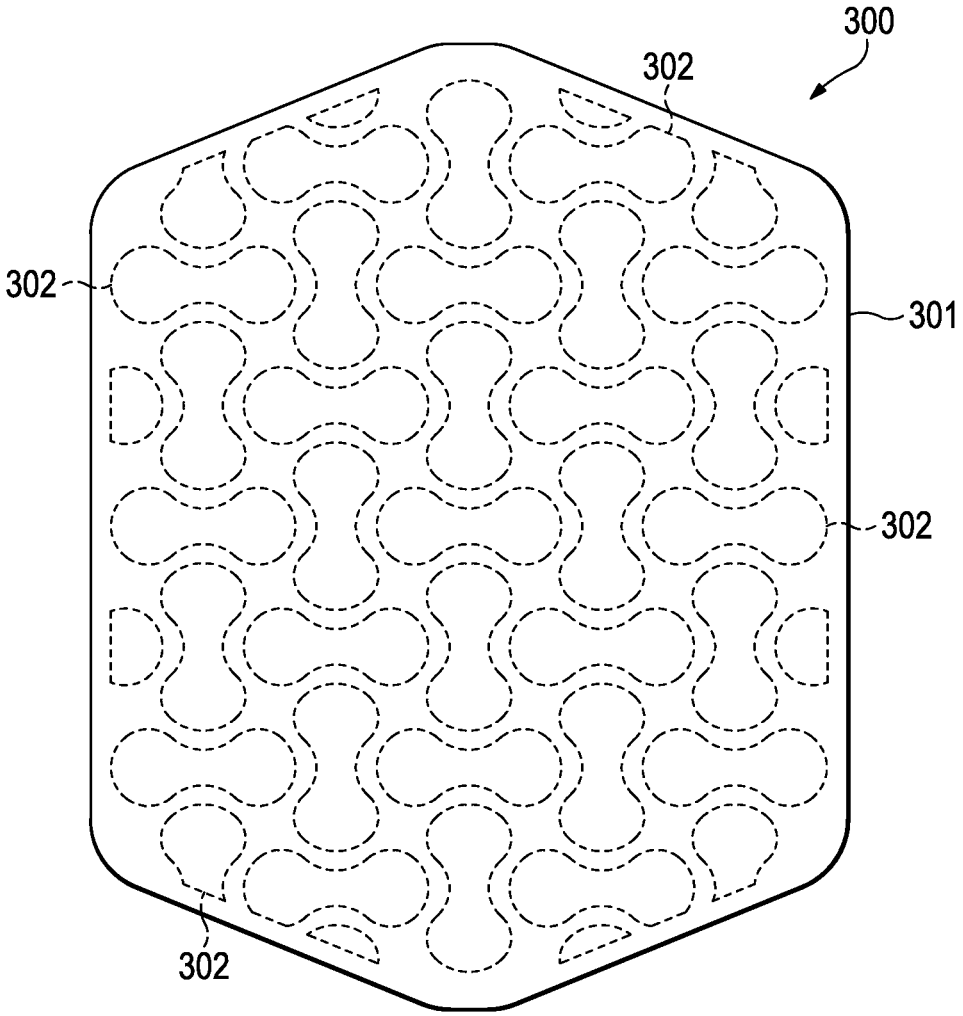
Figure 15E:
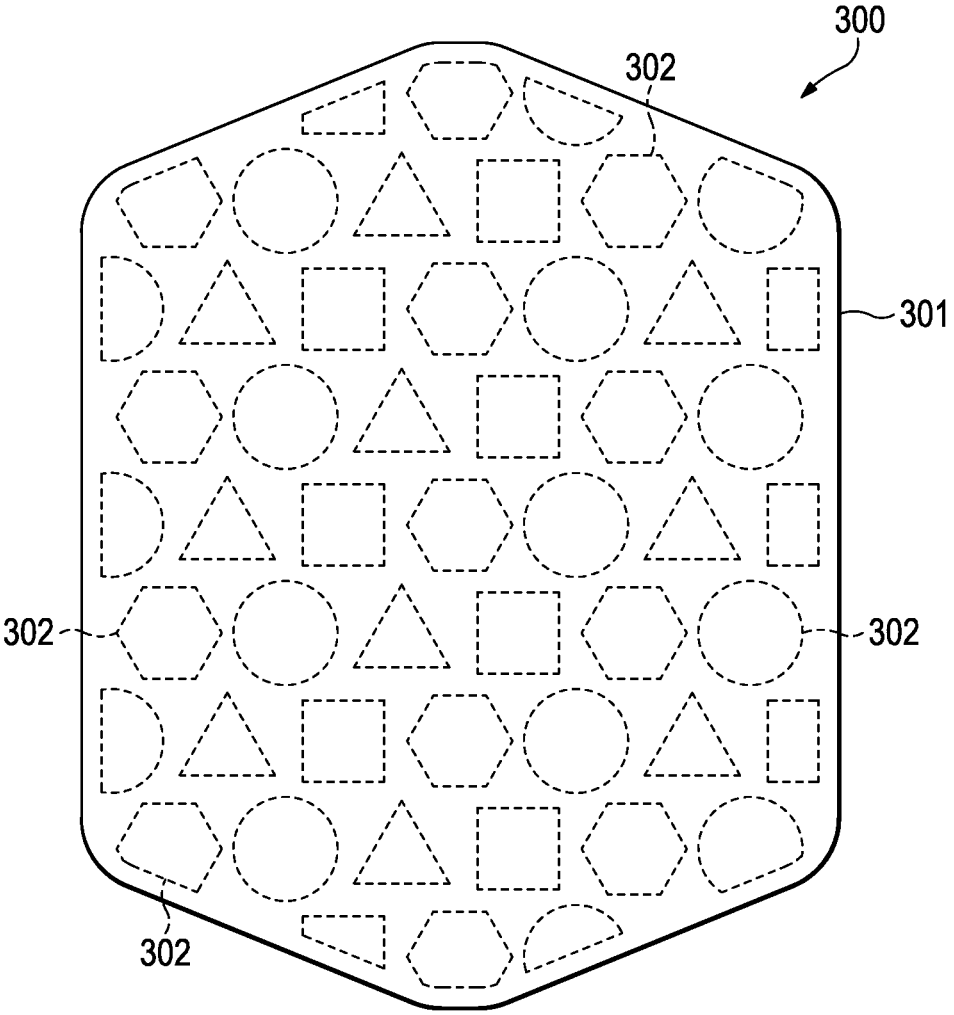
Figure 15F:
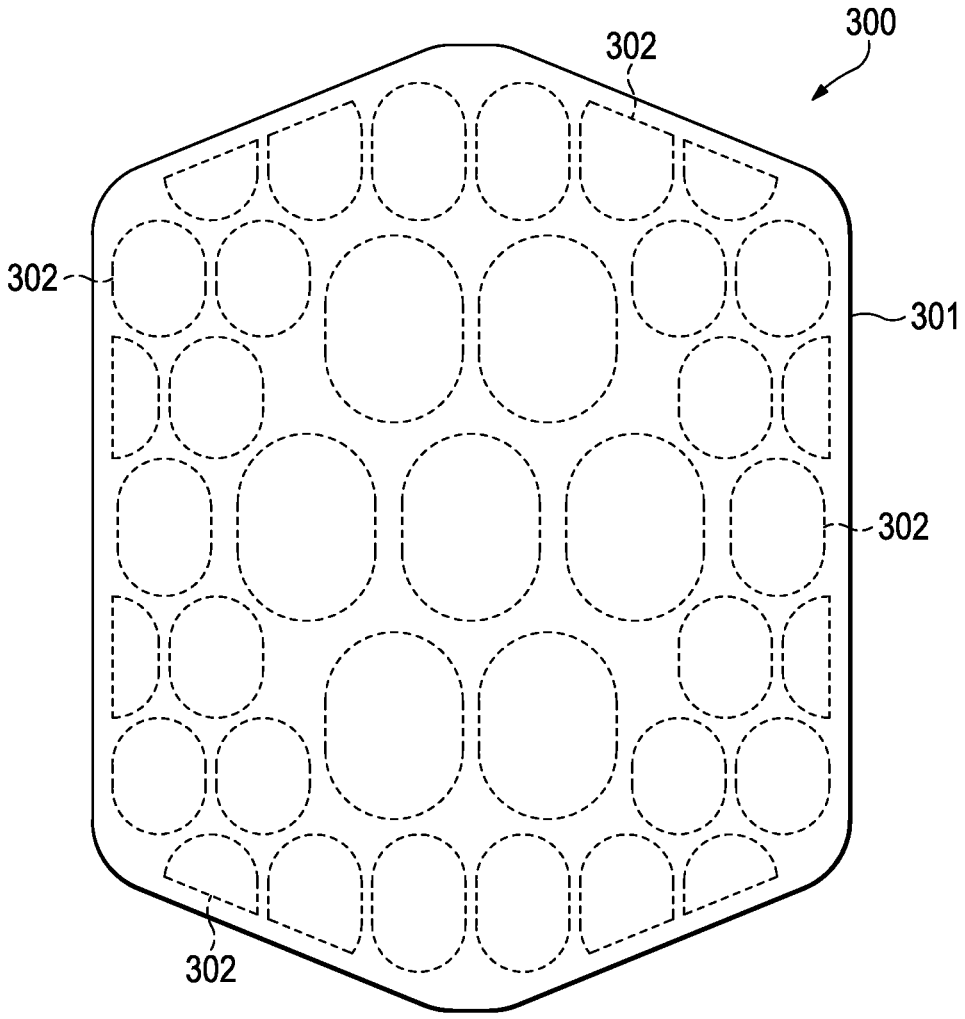

The orientation of the hook part and the loop part of the hook-and-loop fastening system may have an effect upon the overall comfort of apparel 100. In general, the hook part may be formed from relatively stiff polymer filaments that bend to form a plurality of hooks. In comparison, the loop part may be formed from thinner, more-flexible polymer filaments that bend to form loops. As such, orienting (a) the hook part to face away from the wearer and (b) the loop part to face toward the wearer may enhance the comfort of apparel 100. That is, orienting the relatively stiff polymer filaments of the hook part to face away from the wearer may decrease the probability that the filaments or exposed ends of the filaments gouge, impact, or otherwise contact the wearer. In the configuration of FIGS. 2-5, 12A, and 12B, for example, first part 207 is located on exterior surface 205 and oriented to face away from the wearer. As such, first part 207 may be the hook part of the hook-and-loop fastening system, and second part 304 may be the loop part of the hook-and-loop fastening system. In the configuration of FIGS. 13, 14A, and 14B, however, first part 207 is located on interior surface 206 and oriented to face toward the wearer. As such, first part 207 may be the loop part of the hook-and-loop fastening system, and second part 304 may be the hook part of the hook-and-loop fastening system. Despite this advantage, other considerations may warrant placing the hook part in an orientation that faces toward the wearer As discussed above, pad elements 302 may have an elliptical or generally elongate shape with rounded end areas. Pad elements 302 may, however, have a variety of other shapes, including round, triangular, and hexagonal, as respectively depicted in FIGS. 15A-15C. Pad elements 302 may have an irregular shape, as depicted in FIG. 15D, or may be a mixture of different shapes, as depicted in FIG. 15E. Although each of pad elements 302 may have the same shape and size, pad elements 302 may also have generally similar shapes with a variety of different sizes, as depicted in FIG. 15F.

Figure 15G:
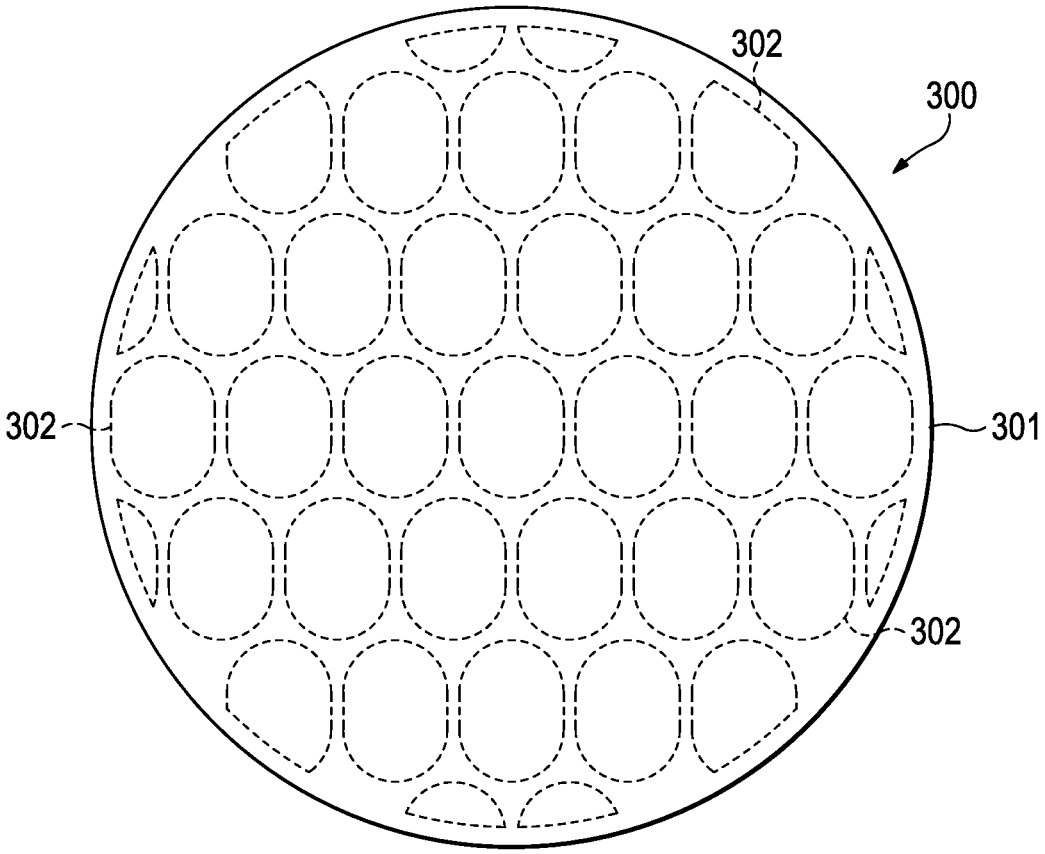
Figure 15H:
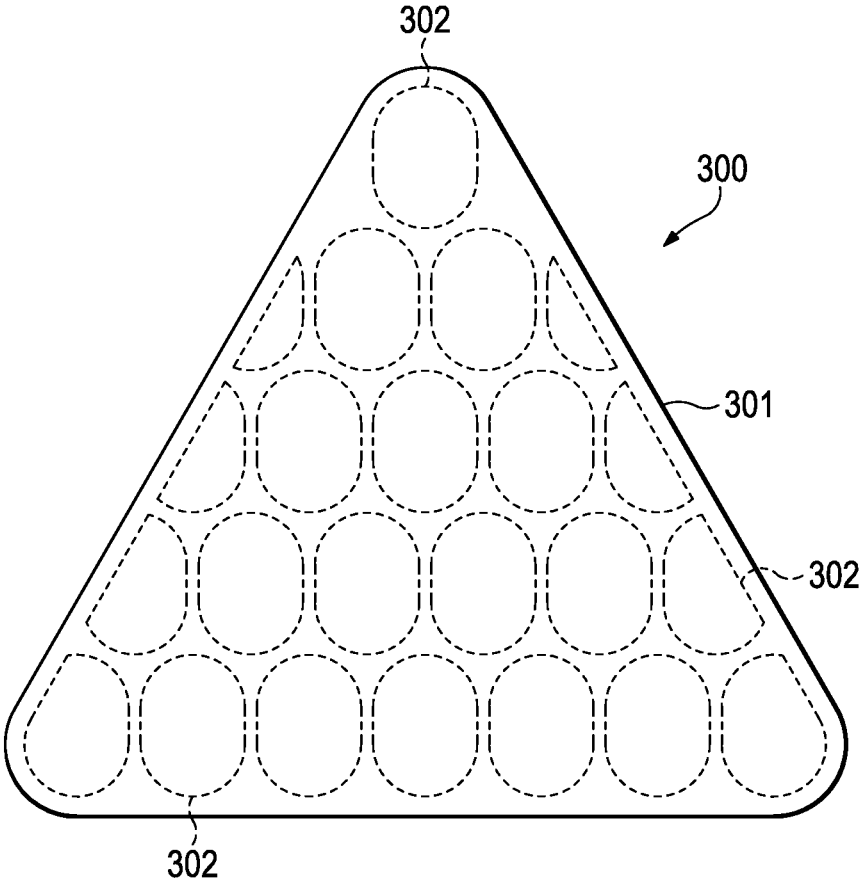
Figure 15I:
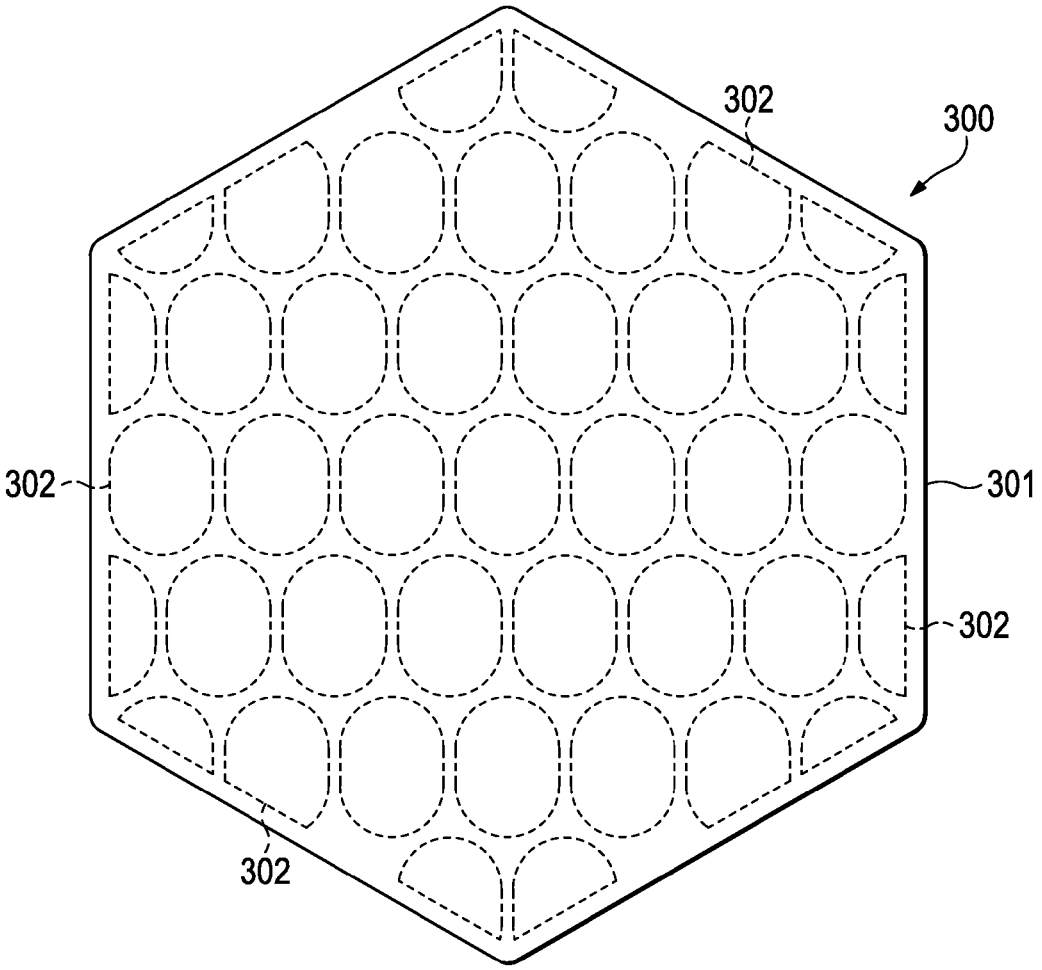
Figure 15J:
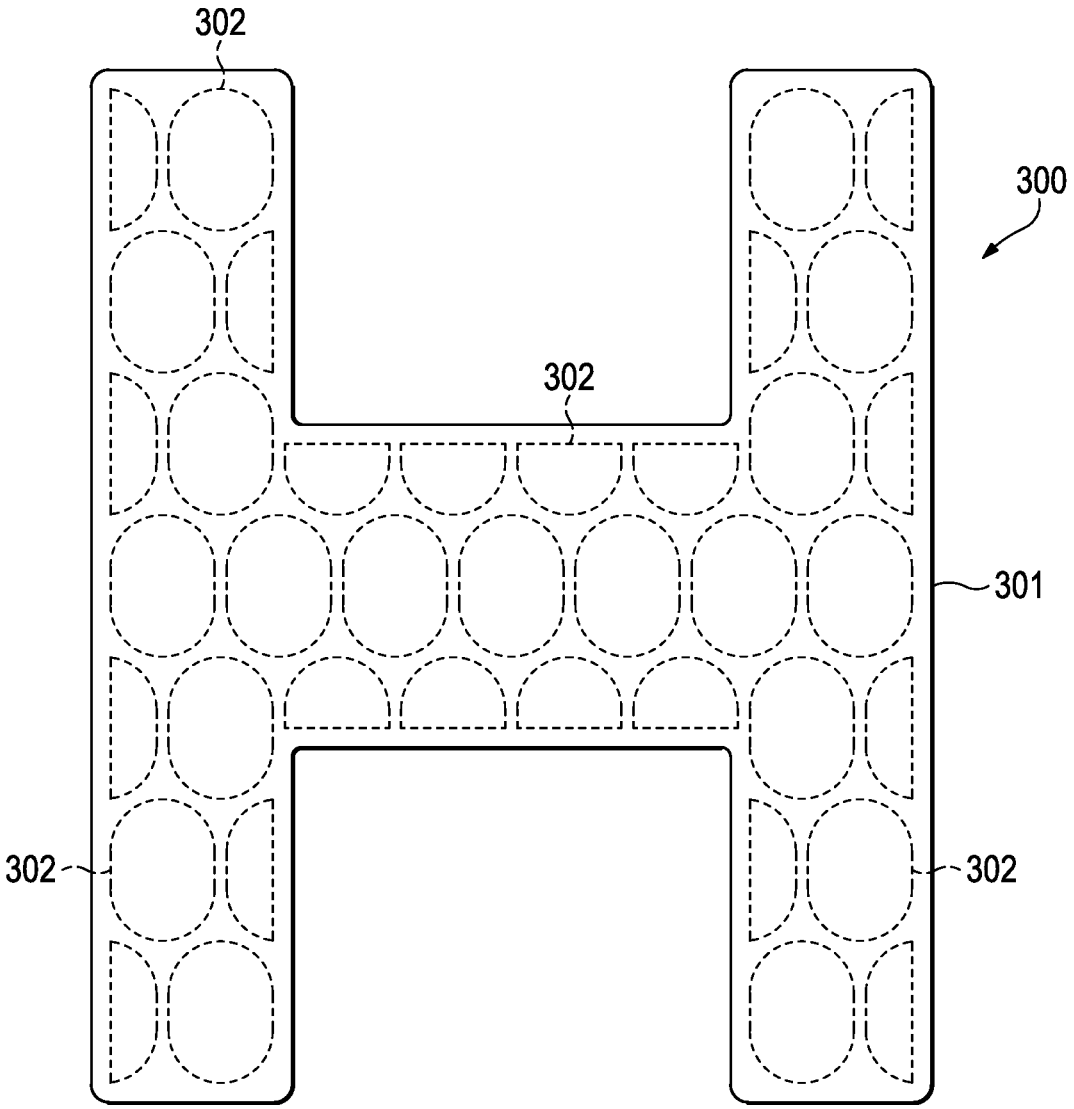
Figure 15K:
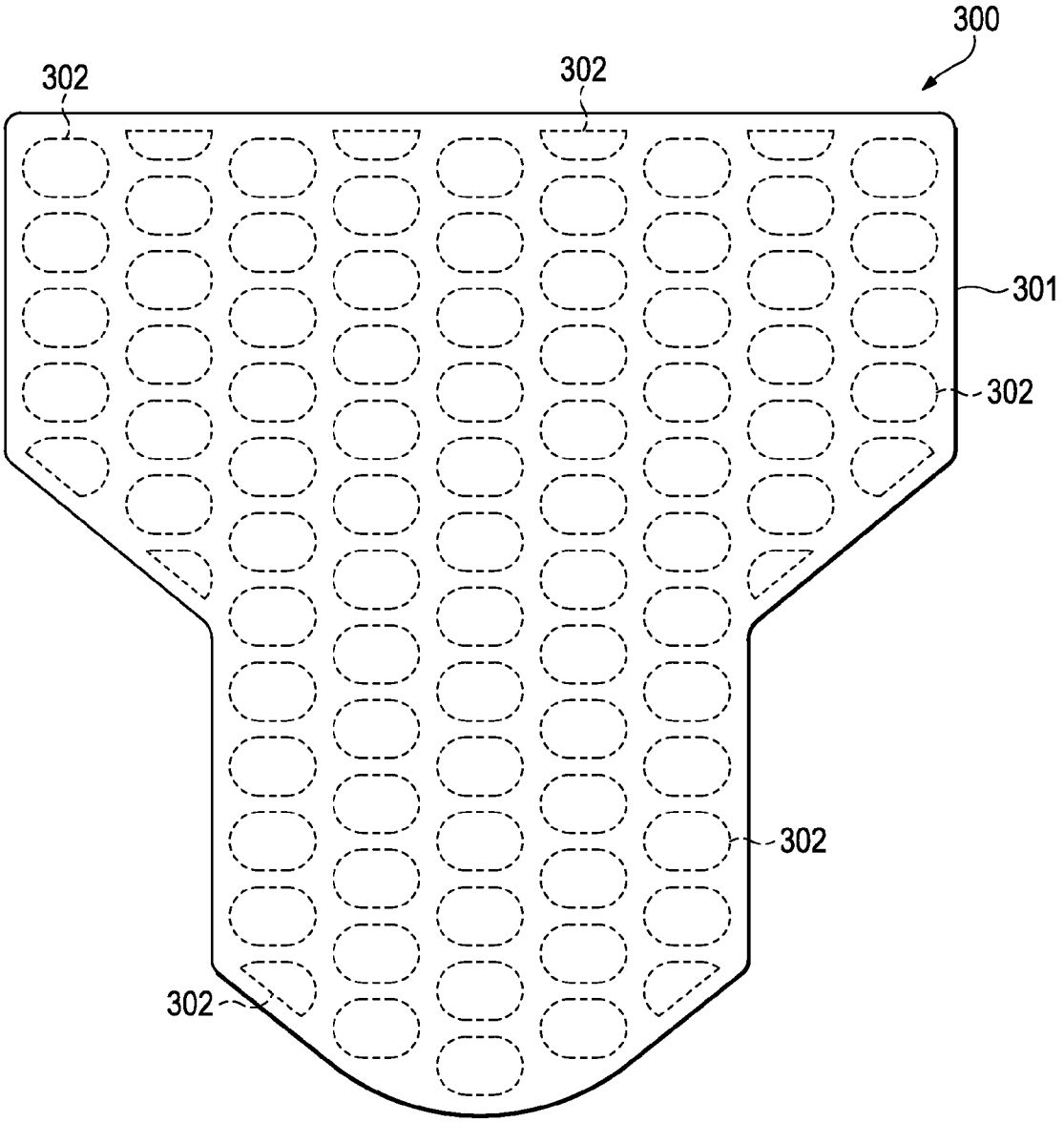
Figure 15L:
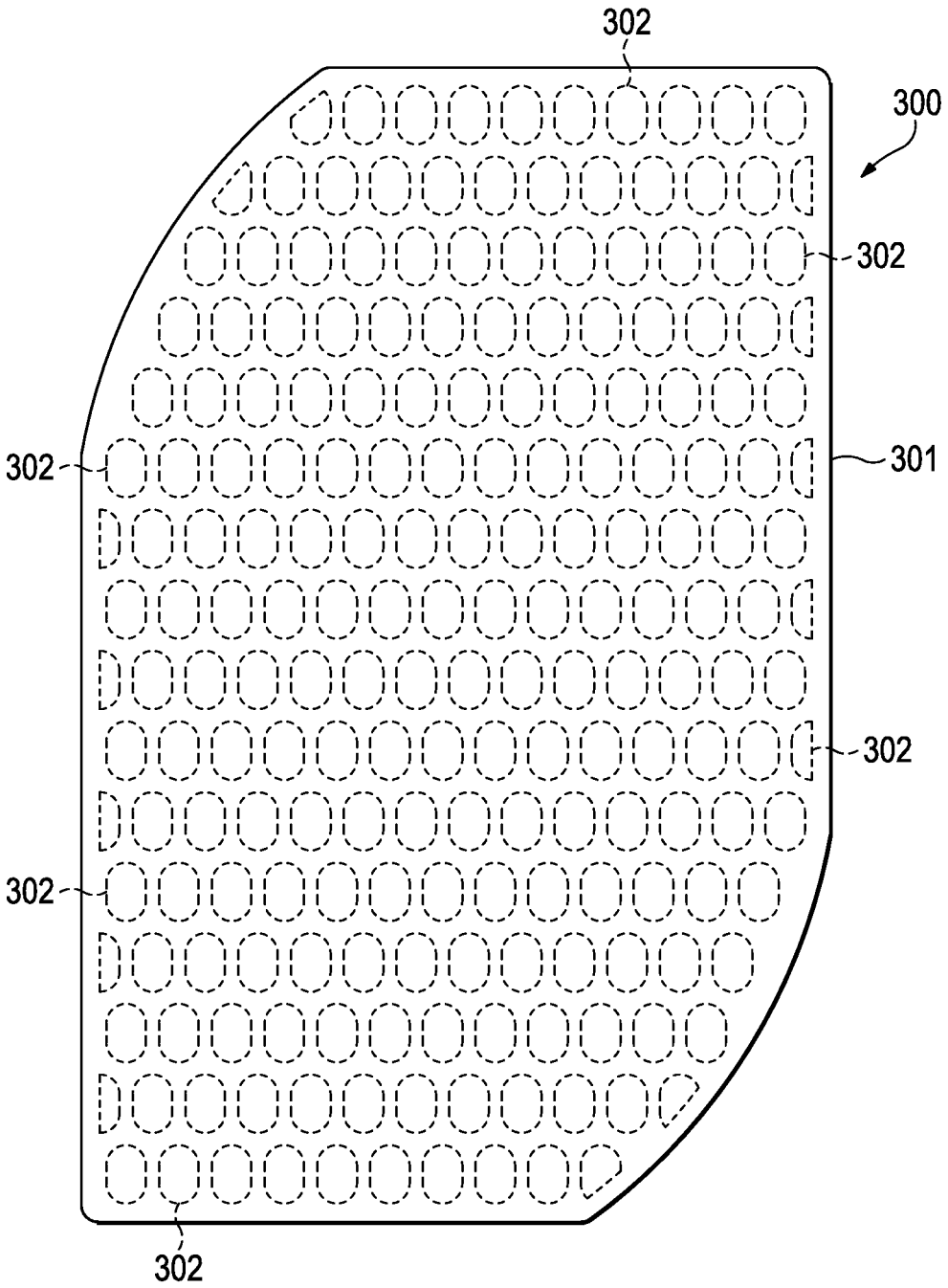

In addition to aspects of pad elements 302 that may vary significantly, the overall shape of attachment components 300 may vary. Referring to FIG. 15G, attachment component 300 exhibits a generally round or circular shape. In further configurations, attachment component 300 may have a triangular, hexagonal, or H-shaped structure, as respectively depicted in FIGS. 15H-15J. Various shapes for attachment component 300 are also depicted in association with apparel 100 in FIG. 7C. As examples of these, one of attachment components 300 that has a shape suitable for a hip pad is depicted in FIG. 15K, one of attachment components 300 that has a shape suitable for a thigh pad is depicted in FIG. 15L.

Figure 15M:
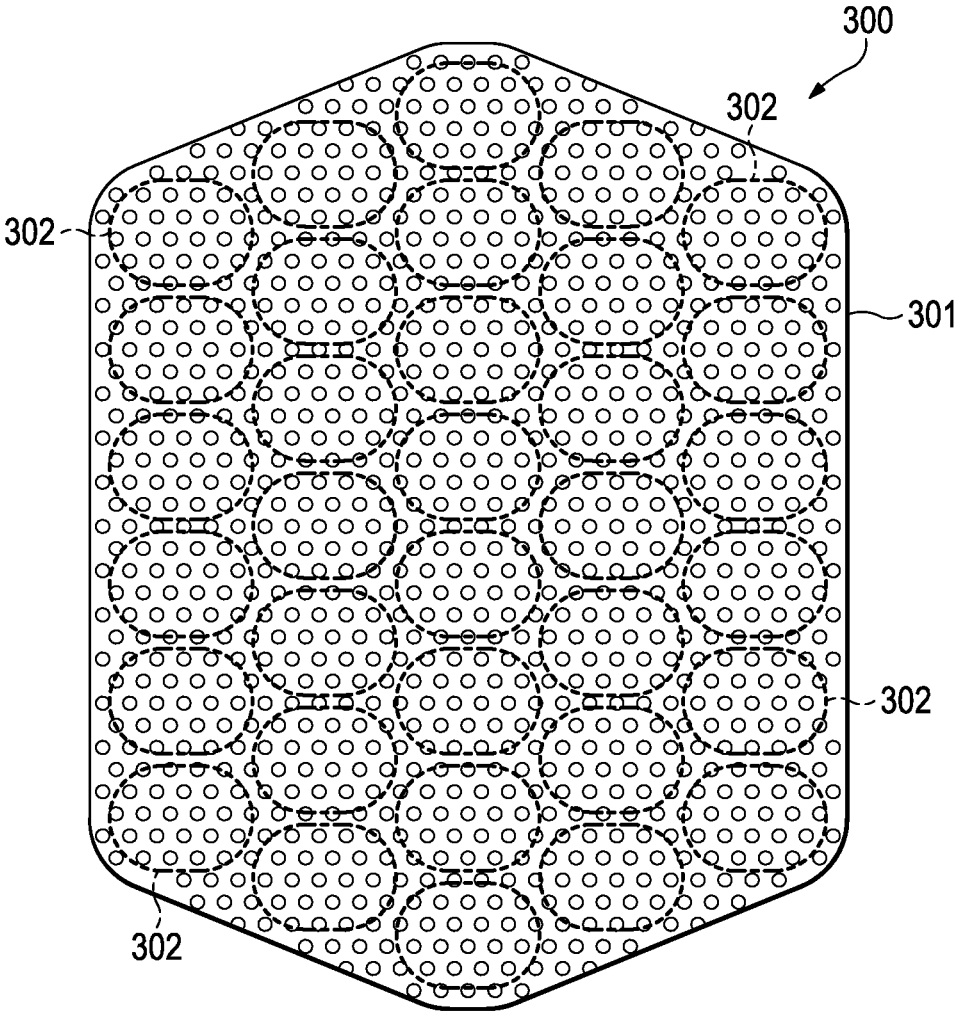

Various aspects relating to cover layer 301 may also vary significantly. As discussed above, cover layer 301 may be formed from various textiles, polymer sheets, leather, synthetic leather, or combinations of materials, for example. Referring to FIG. 15M, cover layer 301 is depicted as having the configuration of a mesh material that defines a plurality of holes, through which pad elements 302 are visible. In addition to imparting greater breathability that allows the transfer of air and moisture, a mesh material may allow for various aesthetic properties. More particularly, pad elements 302 may have different colors that are visible through cover layer 301. In addition to a mesh material, other at least semi-transparent textile or polymer sheet materials may also permit pad elements 302 with different colors to be visible.

Figure 16A:
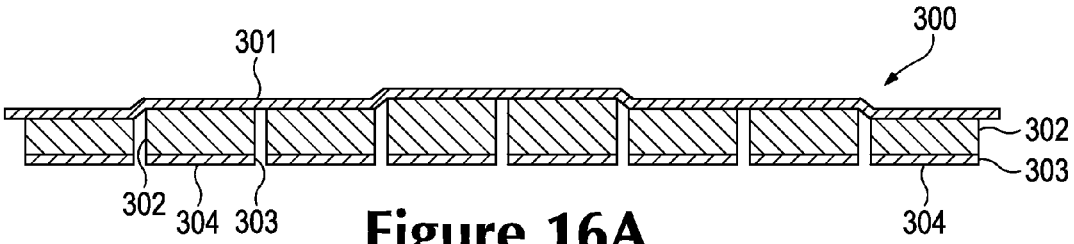
FIGS. 16A-16E are cross-sectional views corresponding with FIG. 11A and depicting further configurations of the attachment component.
Figure 16B:
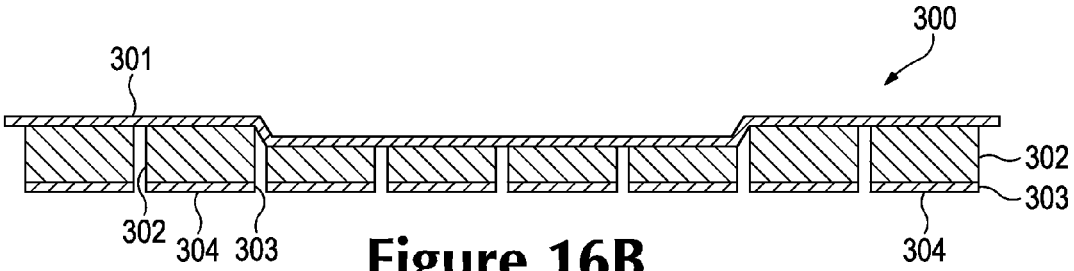
Figure 16C:
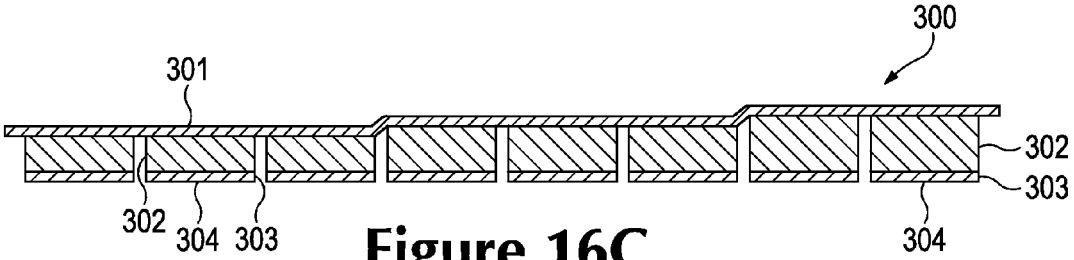
Figure 16D:
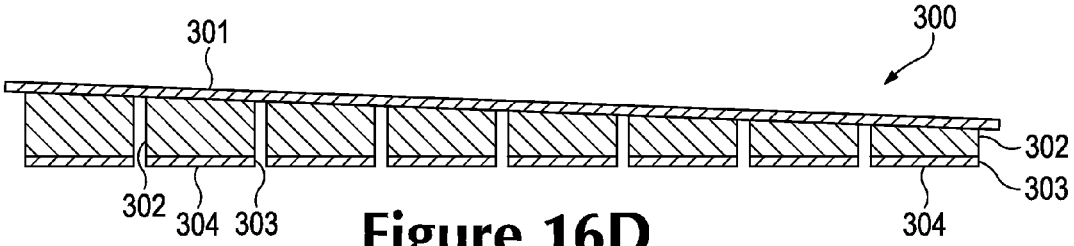

Although the thicknesses of pad elements 302 may be constant, pad elements 302 may also have varying thicknesses, as depicted in FIG. 16A. In some configurations of attachment component 300, pad elements 302 located in the central area may have lesser thickness than pad elements 302 located in the peripheral area, as depicted in FIG. 16B. The thicknesses of pad elements 302 may also decrease across the width of attachment component 300, as depicted in FIG. 16C, or may taper across the width of attachment component 300, as depicted in FIG. 16D.

Figure 11A:
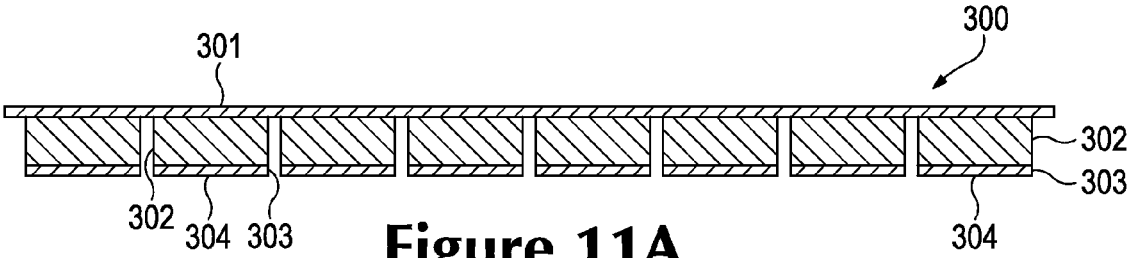
FIGS. 11A and 11B are cross-sectional views of the attachment component, as defined by section lines 11A and 11B in FIG. 10.
Figure 11B:
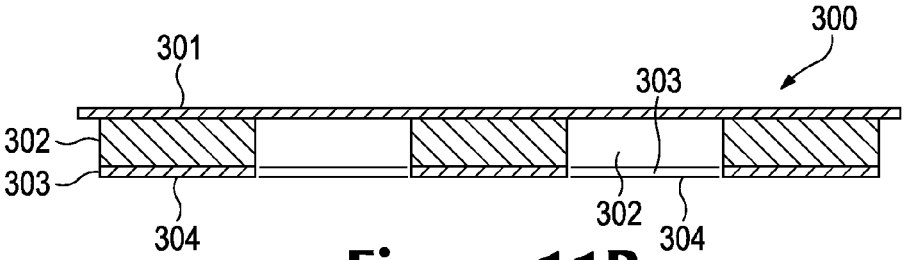
Figure 16E:
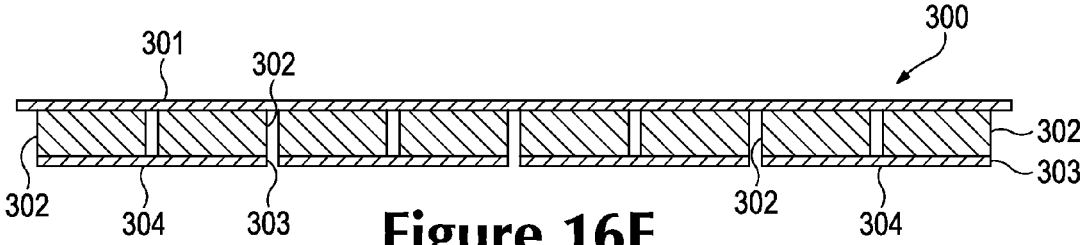

Each securing element 303 is joined to one pad element 302 in FIGS. 11A and 11B. This configuration permits pad elements 302 to move independent of each other, thereby enhancing the flexibility of attachment component 300. Referring to FIG. 16E, however, each securing element 303 is depicted as being joined to two pad elements 302. In this configuration, groups of pad elements 302 may move independent of each other, thereby providing flexibility to attachment component 300. As such, each of securing elements 303 may be joined to at least one and less than all of pad elements 302 in some configurations to provide flexibility.

Figure 17:
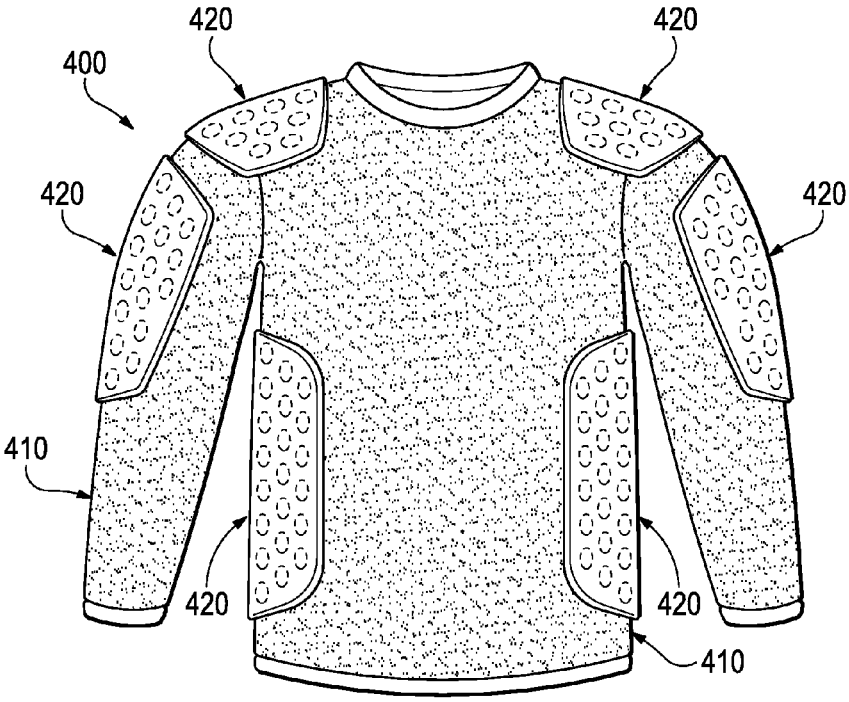
FIG. 17 is a front elevational view of another article of apparel.
Figure 18:
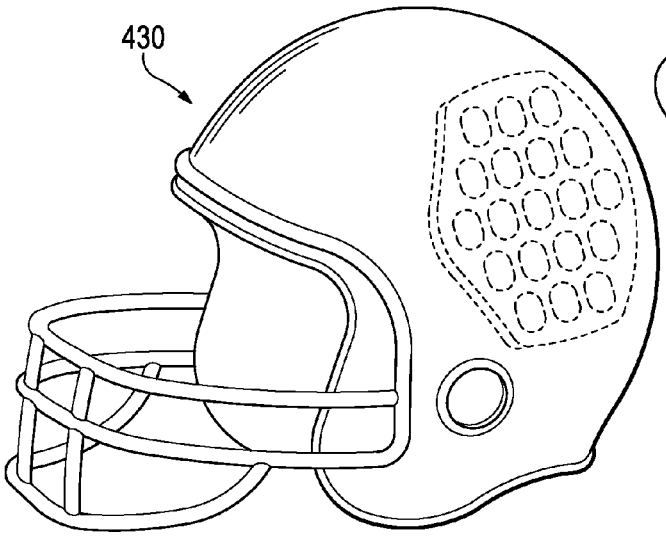
FIG. 18 is a perspective view of another article of apparel.
Figure 19:
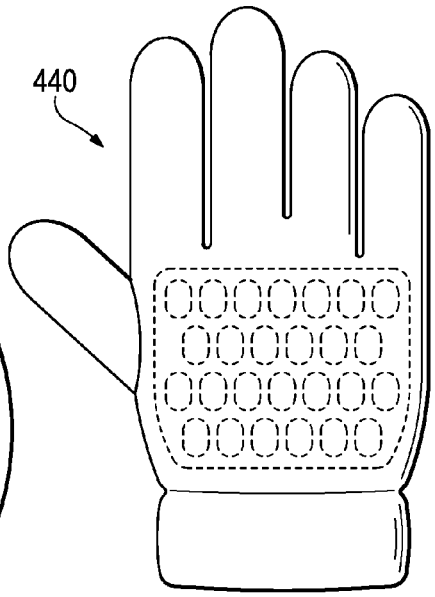
FIG. 19 is a top plan view of another article of apparel.

Apparel 100 exhibits the general configuration of a pair of shorts, but may be another style of pants-type garment that covers a portion of a pelvic region of the wearer and may extend over legs of the wearer, such as pants, briefs, jeans, and underwear. Similarly, concepts from apparel 100 may also be utilized with shirt-type garments that cover a portion of a torso of the wearer and may extend over arms of the wearer, such as long-sleeved shirts, short-sleeved shirts, tank tops, undershirts, jackets, and coats. As an example, FIG. 17 depicts an article of apparel 400 having the configuration of a long-sleeved shirt that includes a base component 410 and a plurality of attachment components 420. In some configurations, the articles of apparel may be combinations of shirt-type garments and pants-type garments, including bodysuits, leotards, unitards, and wetsuits. Additionally, concepts from apparel 100 may be incorporated into protective apparel, including helmets (e.g., football, motorcycle, and bicycling helmets), leg protectors (e.g., a soccer shin guard or baseball catcher's leg guard), and shoulder pads. As an example, a helmet 430 is depicted in FIG. 18. In addition, the articles of apparel may have configurations that cover other areas of the wearer, such as hats, gloves, socks, and footwear, for example. As an example, a glove 440 is depicted in FIG. 19.

Apparel 100 is depicted in FIG. 1 as fitting individual 10 in a relatively tight manner. In some configurations, base component 200 may be intended for use as a compression garment. In addition to therapeutic uses, compression garments are often worn by athletes as a base layer under jerseys or other athletic apparel. In general, compression garments or other garments intended as base layers (a) exhibit a relatively tight fit that lays adjacent to the skin of the wearer and (b) stretch to conform with the contours of the wearer. While the textile materials forming compression garments may have one-directional stretch of, for example, more than ten percent, the textile materials forming other compression garments have multi-directional stretch of at least thirty percent. Accordingly, when apparel 100 is formed to have a relatively tight fit and to stretch to conform with the contours of the wearer, the textile materials forming base component 200 may have two-directional stretch of at least thirty percent.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a base component formed from a plurality of joined material elements, at least one of the material elements including a first part of a hook-and-loop fastening system; and an attachment component that includes (a) a cover layer, (b) a plurality of pad elements, and (c) a plurality of securing elements, wherein each of the plurality of securing elements is separated from a neighboring securing element by a gap, and wherein each of the plurality of securing elements includes a second part of the hook-and-loop fastening system, and wherein each of the plurality of securing elements is joined to and coextensive with at least one and less than all of the pad elements, wherein each of the pad elements is joined to the cover layer, and the first part of the hook-and-loop fastening system being joinable to the second part of the hook-and-loop fastening system to secure the attachment component to the base component.

2. The article of apparel recited in claim 1, wherein the base component defines (a) an exterior surface that faces away from a wearer and (b) an interior surface that faces toward the wearer, the first part of the hook-and-loop fastening system being located on the exterior surface, the first part of the hook-and-loop fastening system including a plurality of hooks, and the second part of the hook-and-loop fastening system including a plurality of loops.

3. The article of apparel recited in claim 1, wherein the base component defines (a) an exterior surface that faces away from a wearer and (b) an interior surface that faces toward the wearer, at least twenty-five percent of the exterior surface or the interior surface including the first part of a hook-and-loop fastening system.

4. The article of apparel recited in claim 1, wherein the base component defines (a) an exterior surface that faces away from a wearer and (b) an interior surface that faces toward the wearer, at least fifty percent of the exterior surface or the interior surface including the first part of a hook-and-loop fastening system.

5. The article of apparel recited in claim 1, wherein the pad elements are spaced from each other on the cover layer.

6. The article of apparel recited in claim 1, wherein at least a portion of the securing elements are joined to one of the pad elements.

7. The article of apparel recited in claim 1, wherein each of the securing elements are joined to one of the pad elements.

8. The article of apparel recited in claim 1, wherein the cover layer is formed from a textile material and the pad elements are formed from a polymer foam material.

9. The article of apparel recited in claim 1, wherein each of the plurality of securing elements corresponds to a pad element, so that any securing element is joined to and coextensive with a single pad element.

10. An article of apparel comprising:

a base component defining (a) an exterior surface that faces away from a wearer and (b) an interior surface that faces toward the wearer, the exterior surface being opposite the interior surface, and at least twenty-five percent of the exterior surface or the interior surface including a first part of a hook-and-loop fastening system; and an attachment component that includes (a) a cover layer, (b) a first pad element and a second pad element, wherein the first pad element and the second pad element are separated from each other by a gap, and (c) a first securing element and a second securing element, wherein the first securing element and the second securing element are separated from each other by the gap, the first pad element and the second pad element being joined to spaced areas of a surface of the cover layer, the first securing element being joined to the first pad element opposite the cover layer, wherein the first securing element is coextensive with the first pad element, and the second securing element being joined to the second pad element opposite the cover layer, wherein the second securing element is coextensive with the second pad element, the first securing element and the second securing element each including a second part of the hook-and-loop fastening system, the first part of the hook-and-loop fastening system being joinable to the second part of the hook-and-loop fastening system to secure the attachment component to the base component.

11. The article of apparel recited in claim 10, wherein the base component is formed from a plurality of joined material elements, at least one of the material elements including the first part of a hook-and-loop fastening system.

12. The article of apparel recited in claim 10, wherein the first part of the hook-and-loop fastening system is located on the exterior surface, the first part of the hook-and-loop fastening system including a plurality of hooks, and the second part of the hook-and-loop fastening system including a plurality of loops.

13. The article of apparel recited in claim 10, wherein at least fifty percent of the exterior surface or the interior surface includes the first part of a hook-and-loop fastening system.

14. The article of apparel recited in claim 10, wherein the cover layer is formed from a textile material and the first pad element and the second pad element are formed from a polymer foam material.

* * * * *